US008115577B2

(12) United States Patent
Nakatsuka et al.

(10) Patent No.: US 8,115,577 B2
(45) Date of Patent: Feb. 14, 2012

(54) ELECTROMECHANICAL SWITCH, FILTER USING THE SAME, AND COMMUNICATION APPARATUS

(75) Inventors: Hiroshi Nakatsuka, Osaka (JP); Yasuyuki Naito, Osaka (JP); Keiji Onishi, Osaka (JP)

(73) Assignee: Panasonic Corporation, Osaka (JP)

( * ) Notice: Subject to any disclaimer, the term of this patent is extended or adjusted under 35 U.S.C. 154(b) by 616 days.

(21) Appl. No.: 12/137,812

(22) Filed: Jun. 12, 2008

(65) Prior Publication Data

US 2009/0014295 A1 Jan. 15, 2009

(30) Foreign Application Priority Data

Jun. 14, 2007 (JP) ..... 2007-157732

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 7,161,273 | B2 * | 1/2007 | Akiba et al. | 310/309 |
| 7,283,025 | B2 * | 10/2007 | Lee et al. | 335/78 |
| 7,352,266 | B2 * | 4/2008 | Chou | 335/78 |
| 7,405,641 | B1 * | 7/2008 | Hsu et al. | 335/78 |
| 7,683,746 | B2 * | 3/2010 | Nakanishi | 335/78 |
| 2002/0005341 | A1 * | 1/2002 | Seki | 200/181 |
| 2006/0208837 | A1 * | 9/2006 | Masuda et al. | 335/78 |
| 2007/0126536 | A1 * | 6/2007 | Fork et al. | 335/78 |

FOREIGN PATENT DOCUMENTS

| | | |
|---|---|---|
| JP | 2005-527963 | 9/2005 |
| JP | 2005-302411 | 10/2005 |

OTHER PUBLICATIONS

Jeremy B. Muldavin "Inline Capacitive and DC-Contact MEMS Shunt Switches" IEEE Microwave and Wireless Components Letters; Aug. 2001; pp. 334-336; vol. 11 No. 8.

Charles L. Goldsmith et al "Performance of Low-Loss RF MEMS Capacitive Switches" IEEE Microwave and Guided Wave Letters; Aug. 1998; pp. 269-271; vol. 8 No. 8.

* cited by examiner

*Primary Examiner* — Anh Mai
*Assistant Examiner* — Bernard Rojas
(74) *Attorney, Agent, or Firm* — Pearne & Gordon LLP

(57) ABSTRACT

An electromechanical switch includes a first beam, a second beam arranged in parallel with the first beam and connected to the first beam through a connecting portion, a first electrode formed so as to have a first gap with respect to the first beam, a voltage applying portion which applies a voltage between the first beam and the first electrode, and a second electrode formed so as to have a second gap with respect to the second beam. The second gap is greater than the first gap. The first beam is displaced when the voltage applying portion applies the voltage between the first beam and the first electrode, so that switching between the second beam and the second electrode is performed in a state that the first beam is not electrically connected to the first electrode.

16 Claims, 22 Drawing Sheets

ELECTROMECHANICAL SWITCH, FILTER USING THE SAME, AND COMMUNICATION APPARATUS

BACKGROUND

The present invention relates to an electromechanical switch, and more particularly to a switch, a filter, and a communication apparatus used for switching high frequency signals in a high frequency circuit in a mobile communication terminal, and used in digital television broadcasting, mobile phone and wireless LAN.

A conventional RF-MEMS switch is a mechanical switch in which a movable element formed into a membrane or rod shape is fixed at both ends or only at one end thereof so as to be brought into contact with or separated from an electrode to thereby switch propagation paths of signals. While in many publications, electrostatic force is used as a source of force actuating the membrane and the movable element, magnetic force is also used in many other publications as the source of such actuating force.

As a minute switch of a size in the order of 100 μm, there is conventionally known one described in Non-Patent Document 1. The configuration of the conventional switch described in Non-Patent Document 1 is shown in FIGS. 22A and 22B. FIG. 22A is a sectional view showing the configuration of the conventional switch, and FIG. 22B is a plan view showing the configuration of the conventional switch. FIG. 22A is the sectional view sectioned along the line A-A' in FIG. 22B. In this switch, a signal line 1 along which a high-frequency signal is transmitted is formed on a membrane, and a control electrode 3 is provided directly below the signal line 1.

When a direct current potential is applied to the control electrode 3, the membrane is pulled towards the control electrode 3 by virtue of electrostatic pulling force and is then deflected to be brought into contact with a ground electrode 4 formed on a substrate 2. As a result, the signal line 1 formed on the membrane comes into a short-circuited state, and the signal flowing through the signal line 1 is attenuated to be cut off.

On the other hand, when the direct current potential is not applied to the control electrode 3, the membrane is not deflected. The signal flowing through the signal line 1 on the membrane from the ground electrode 4 passes through the switch with no loss.

[Non-Patent Document 1]

IEEE Microwave and Wireless Components Letters, Vol. 11 No. 8, August 2001 p 334

As properties of the electromechanical switch, it is necessary to ensure isolation when the switch is off as well as reduce pull-in voltage necessary for switching operations.

In the conventional electromechanical switch, however, when a configuration is adopted in which the gap is increased to ensure the isolation, resulting in a large displacement, there is caused a problem that the pull-in voltage necessary for switching operations has to be increased, Conversely, when a configuration is adopted in which the gap is decreased to reduce the pull-in voltage, there is caused a problem that the isolation is reduced when the switch is off. Thus, the actuation with the low voltage and the isolation characteristic are in an incompatible or trade-off relationship.

SUMMARY

Then, the invention has been made in view of these situations and an object thereof is to provide an electromechanical switch which can solve the conventional problems and make low voltage actuation compatible with high isolation.

In addition, another object of the invention is to realize such characteristics as small size, low loss and high isolation by a filter and communication apparatus with the electromechanical switch provided by the invention.

In order to achieve the above object, according to the present invention, there is provided an electromechanical switch, comprising:

a first beam, serves as an actuating portion;

a second beam arranged in parallel with the first beam, and connected to the first beam through a connecting portion, the second beam serving as a contact portion;

a first electrode formed so as to have a first gap with respect to the first beam, the first electrode serving as a actuating electrode;

a voltage applying portion which applies a voltage between the first beam and the first electrode; and a second electrode formed so as to have a second gap with respect to the second beam and served as a contact electrode, the second gap being greater than the first gap, wherein the first beam is displaced when the voltage applying portion applies the voltage between the first beam and the first electrode, so that switching between the second beam and the second electrode is performed in a state that the first beam is not electrically connected to the first electrode.

By this configuration, the first beam is displaced by a voltage being applied between the first beam and the first electrode and then transmitting the displacement produced in the actuating portion to the contact portion via the connecting portion so as to displace the contact portion, whereby switching Is implemented. As a result of this, the different gaps can be defined for the actuating portion and the contact portion, whereby not only can the electrical isolation be ensured when the switch is off but also the pull-in voltage at the time of actuation can be reduced.

In addition, in this configuration, since the actuating portion and the contact portion do not exist on the same plane, isolation can easily be ensured. Additionally, a low voltage actuation is enabled. In the case of actuation being implemented through the electrostatic approach or piezoelectric approach, since the electric field necessary for actuation concentrates on the first beam and the first electrode, even when the switch is used in such communication apparatus as a mobile phone, there is caused no situation where peripheral circuits are badly affected by the electric field. In addition, when the switch is actuated by the electrostatic approach or piezoelectric approach, since only voltage is applied and no current is generated, the actuation of the switch consumes no electric power.

Additionally, electrostatically actuated switches can be fabricated only through the standard CMOS process. Furthermore, since the first electrode and the second electrode are made of the same material, not only is the fabrication facilitated but also the electrostatic force is applied to not only the first electrode but also the second electrode, enabling an actuation with lower voltage.

Preferably, the first electrode and the second electrode are formed on a substrate. A pulling force is generated between the first beam and the first electrode when the voltage applying portion applies the voltage between the first beam and the first electrode, so that the first beam is displaced. The connecting portion transmits a displacement of the first beam to the second beam so that the second beam is displaced. The second beam contacts with the second electrode to switch on and off an electric signal by a displacement of the second beam.

Preferably, the first beam is displaced by electrostatic force.

In this configuration, since the electric field necessary for actuation concentrates on the first beam and the first electrode, even when the switch is used in such communication apparatus as a mobile phone, there is caused no situation where peripheral circuits are badly affected by the electric field, In addition, when the switch is actuated by the electrostatic approach or piezoelectric approach, since only voltage is applied and no current is generated, the actuation of the switch consumes no electric power. Additionally, electrostatically actuated switches can be fabricated only through the standard CMOS process. Furthermore, since the first electrode and the second electrode are made of the same material, not only is the fabrication facilitated but also the electrostatic force is applied to not only the first electrode but also the second electrode, enabling an actuation with lower voltage.

Preferably, a surface of the first electrode is covered with an insulation membrane.

By this configuration, the magnitude of the gap can be decreased by the thickness of the insulation membrane without causing any change in height of the surfaces of the first and second electrodes, the formation of the switch using the MEMS process being thereby facilitated.

Preferably, the first electrode and the second electrode are formed on the same plane.

By this configuration, the number of fabricating manhours in the MEMS process can be reduced, and the fabrication is facilitated. Furthermore, the magnitude of the gap can be decreased by the thickness of the insulation membrane without causing any change in height of the surfaces of the first and third electrodes, the formation of the switch using the MEMS process being thereby facilitated.

Preferably, a top face of the second electrode is lower in the height from a common level than that of the first electrode.

By this configuration, isolation when the switch is off can be maintained in a more ensured fashion.

Preferably, the first beam is configured as a both-end fixed beam. The second beam is configured as a cantilevered beam. The both-end fixed beam is connected to the cantilevered beam through the connecting portion.

In this configuration, the both-end fixed beam constitutes the actuating portion which produces a displacement, while the cantilevered beam constitutes the contact portion which switches on and off an electric signal. In this electromechanical switch, since the displacement produced in the actuating portion can be magnified in the contact portion via the connecting portion for operation, switching can be implemented even in the event that there are provided the different gaps for the actuating portion and the contact portion. In addition, actuation can be implemented through smaller distortion by magnifying in the contact portion the small displacement produced in the actuating portion, thereby making it possible to increase the mechanical reliability of the switch.

Preferably, the first beam and the second beam are configured as cantilevered beams. The cantilevered beams are connected to each other through the connecting portion.

By this configuration, actuation can be implemented through smaller distortion by making the length of the second beam longer than the length of the first beam, thereby making it possible to increase the mechanical reliability of the switch.

Preferably, the first beam and the second beam are configured as both-end fixed beams. The both-end fixed beams are connected to each other through the connecting portion.

By this configuration, a stable actuation can be realized.

Preferably, a plurality of the first beam or a plurality of the second beam are provided.

By this configuration, a construction is made up in which a plurality of both-end fixed beams and a plurality of cantilevered beams are connected by a plurality of connecting portions. As this occurs, the plurality of both-end fixed beams make up the actuating portion, while the plurality of cantilevered beams make up the contact portion. In the electromechanical switch configured in this way, since the displacement produced in the actuating portion can be magnified in the contact portion via the connecting portion for operation, switching can be implemented even in the event that there are provided the different gaps for the actuating portion and the contact portion.

Preferably, a mechanical resonance frequency of the first beam is different from that of the second beam.

By this configuration, since the second beam is made to realize a larger displace with a smaller force, the displacement produced in the actuating portion can be propagated to the contact portion with good efficiency.

Preferably, a length of the connecting portion is not more than one half of a structural body of the electromechanical switch.

By this configuration, the magnification of displacement can be enabled.

Preferably, a length of the connecting portion is set to one fourth of a structural body of the electromechanical switch.

By this configuration, the displacement produced in the actuating portion can be propagated to the contact portion with good efficiency, the effect of magnification of the displacement being thereby made maximum.

Preferably, the first beam is displaced by piezoelectric effect.

In this configuration, since the electric field necessary for actuation concentrates on the first beam and the first electrode, even when the switch is used in such communication apparatus as a mobile phone, there is caused no situation where peripheral circuits are badly affected by the electric field. In addition, the switch can be fabricated only by the standard CMOS process excluding piezoelectric films of AlN and PZT. Furthermore, since the first electrode and the second electrode are made of the same material, the fabrication of the switch is facilitated. In addition, piezoelectric effect acts on not only the first electrode but also the second electrode, this enabling actuation with lower voltage.

Preferably, the first beam is displaced by both electrostatic effect and piezoelectric effect.

In the electrostatic approach, it is effective to dispose the actuating electrode in a portion where displacement becomes large, while in the piezoelectric approach, it is effective to dispose the actuating electrode in a portion where distortion becomes large. Because of this, in a hybrid actuation, the actuating portion can be made to match the characteristics of the respective approaches.

In other electromechanical switches according to the invention, in a structural element, a plurality of cantilevered beams are made up of the plurality of connecting portions. By adopting this configuration, since the contact portion can be actuated from both sides thereof, stable switching can be implemented.

A filter of the present invention is provided with the electromechanical switch.

By the filter being configured as described above, the device can be made smaller in size and the loss thereof can be reduced, and the advantage of using the electromechanical switch of the invention is large.

A duplexer of the present invention is provided with the electromechanical switch.

By the filter being configured as described above, the device can be made smaller in size and the loss thereof can be reduced, and the advantage of using the electromechanical switch of the invention is large.

A communication apparatus of the present invention is provided with the duplexer. As a result of this, the loss of the device can be reduced, and the size thereof can also be reduced.

In the electromechanical switch according to the invention, by forming the actuating portion and the contact portion into the different beams, the first gap defined between the actuating electrode and the first beam and the second gap defined between the contact electrode and the second beam can be formed in different magnitudes (the first gap<the second gap), whereby high isolation when the switch is off and low voltage actuation by high electrostatic force when the switch is actuated can be realized. In addition, the displacement of the beam produced in the actuating portion is made to be transmitted to the contact portion via the connecting portion, and the connecting portion is made into the cantilevered beam and is made to operate in the cantilevered fashion, whereby even in the configuration in which the first gap<the second gap, the electromechanical switch can be realized which is highly electrically and mechanically reliable.

Furthermore, with the filter and communication apparatus which utilize the electromechanical switch of the invention, the reduction in loss and size can be facilitated, and there can be provided an advantage that even a plurality of communication systems can be made up using a small number of switches.

Thus, judging from the viewpoints described above, the construction of the invention can provide a great advantage in utilizing the electromechanical switch thereof.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

Hereinafter, an electromechanical switch according to the invention will be described in detail by reference to some preferred embodiments shown in the accompanying drawings.

(Embodiment 1)

Embodiment 1 will be described by reference to FIGS. 1A to 1C and FIGS. 2A to 2D.

Figure 1A:
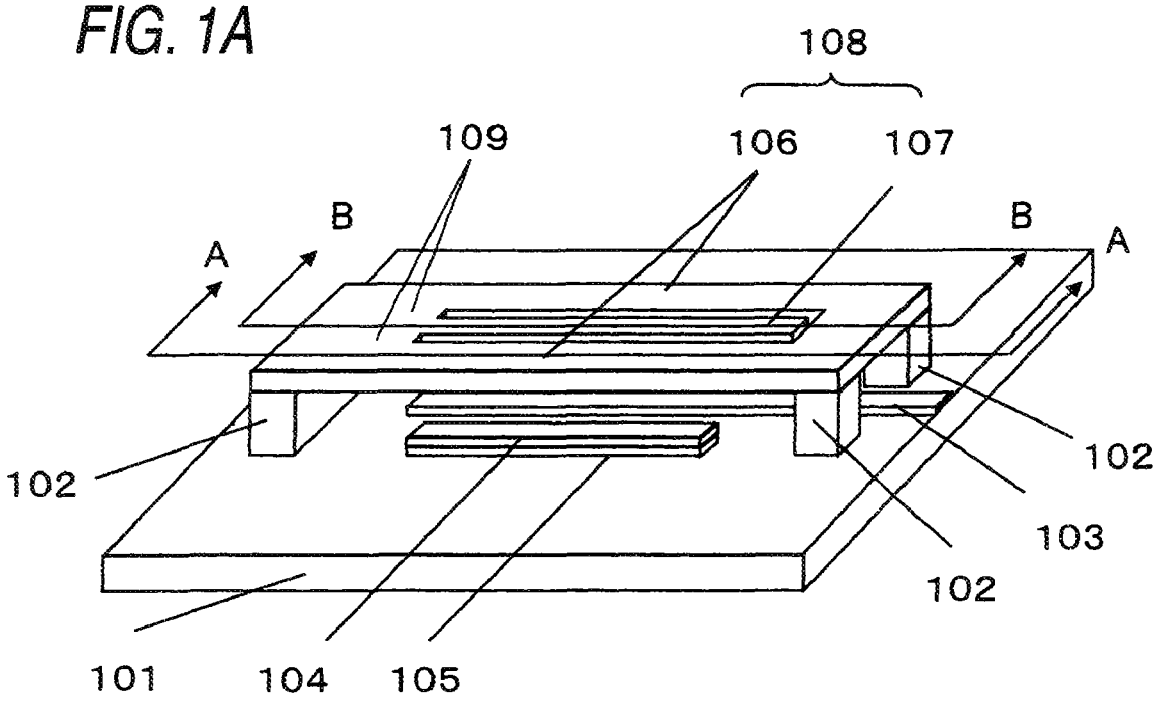
FIG. 1A is a perspective view of an electromechanical switch according to Embodiment 1 of the invention.
Figure 1B:
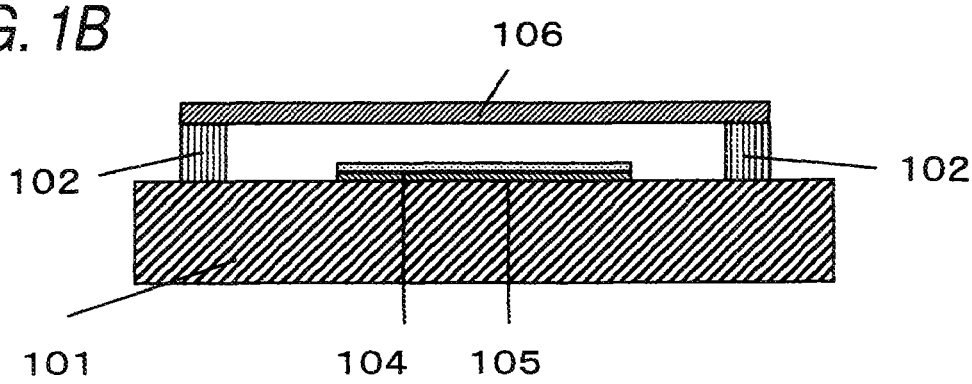
FIG. 1B is a sectional view of the switch taken along the line A-A.
Figure 1C:
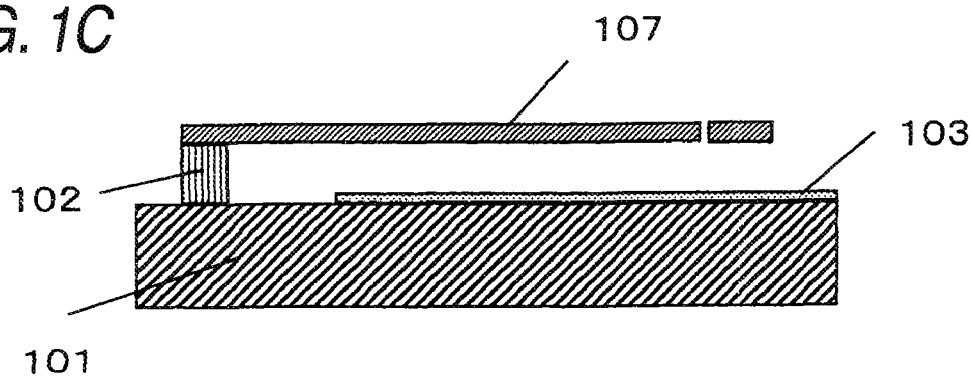
FIG. 1C is a sectional view of the switch taken along the line B-B.

FIGS. 1A to 1C show drawings of a micromachine switch as an electromechanical switch according to Embodiment 1 of the invention. FIG. 1A is a perspective view of the electromechanical switch, FIG. 1B is a sectional view of the electromechanical switch taken along the line A-A in FIG. 1A, and FIG. 1C is a sectional view of the same taken along the line B-B in FIG. 1A.

Figure 2A:
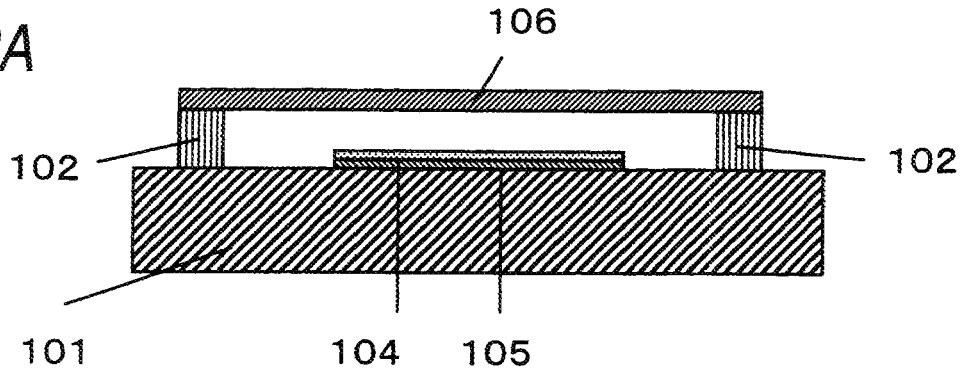
FIG. 2A is a sectional view showing a first beam of the electromechanical switch in an off state depicted in FIGS. 1A.
Figure 2B:
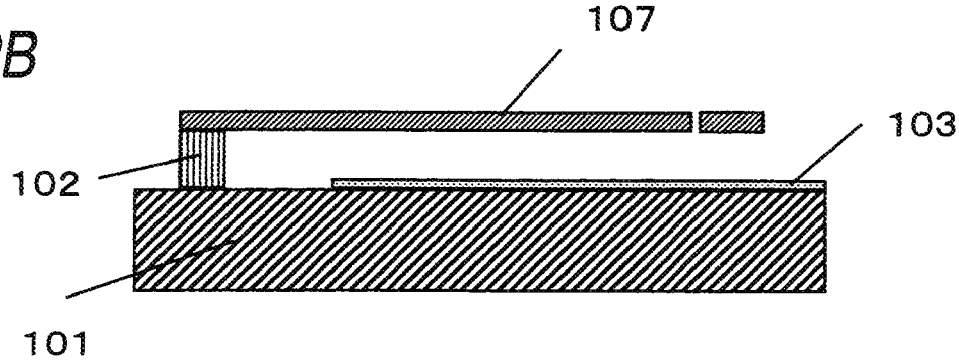
FIG. 2B is a sectional view showing a second beam of the electromechanical switch in the off state depicted in Fig. IA.
Figure 2C:
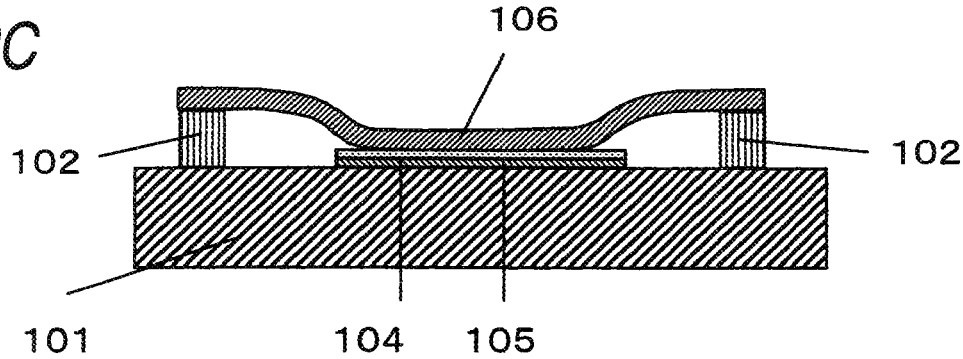
FIG. 2C is a sectional view showing the first beam of the electromechanical switch in an on state depicted in FIGS. 1A.
Figure 2D:
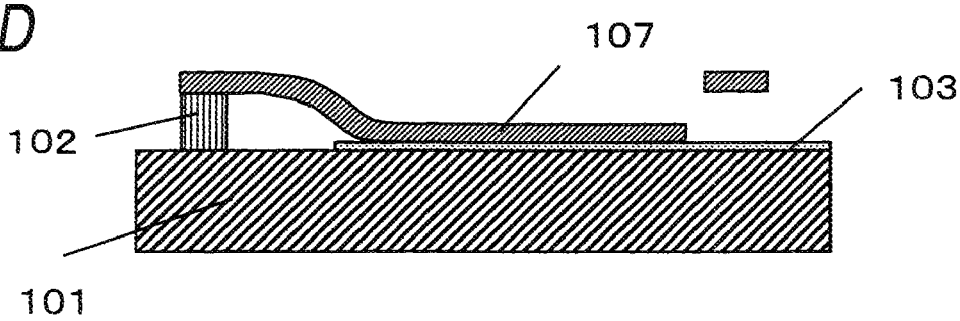
FIG. 2D is a sectional view showing a second beam of the electromechanical switch in the on state depicted in FIG. 1A.

FIGS. 2A to 2D show sectional views which illustrate an on state and an off state of the electromechanical switch according to Embodiment 1. FIGS. 2A and 2B are sectional views showing the electromechanical switch in the off state and correspond to FIGS. 1B and 1C. FIGS. 2C and 2D are sectional views showing the switch being in the on state and illustrate that first and second beams shown in FIGS. 2A and 2B are displaced, This electromechanical switch is formed through the MEMS process using a silicon substrate as a constituent material. The electromechanical switch includes a first beam 106 and a second beam 107. The first beam 106 is made up of two both-end fixed beams and constitutes an actuating portion. The second beam 107 is made up of a cantilevered beam and constitutes a contact portion 107. The first and second beams being placed in parallel in such a manner that the second beam is held between the two both-end fixed beams of the first beam 106. The electromechanical switch also includes a first electrode as an actuating electrode 105 and a second electrode as a wiring electrode (a contact electrode) 103. The actuating electrode 105 is formed so as to have a first gap between the first beam 106 and the actuating electrode 105. The wiring electrode 103 is formed so as to have a second gap between the second beam 107 and the wiring electrode 103. The second gap is greater than the first gap. While hereinafter, reference numeral 103 shown in FIG. 1 is understood to denote the wiring electrode, the wiring contact should include a contact with which the second beam is brought into abutment, that is, a contact electrode and its peripheral wiring.

Referring to FIG. 1A, reference numeral 101 denotes a substrate into which constituent elements of a micromachine device are incorporated. Silicone, gallium arsenic, SiC and the like can be used as materials for the substrate. Support portions 102 are provided on the substrate 101 as spacers which support a structural element 108 on the substrate 101 with a predetermined gap provided therebetween. A U-shaped slit is provided in the structural element 108 so as to divide the structural element 108 into the first beam 106 which constitutes the actuating portion and the second beam 107 which constitutes the contact portion. The first beam 106 constituting the actuating portion is constructed as the both-end fixed beam, while the second beam 107 constituting the contact portion is constructed as the cantilevered beam. The displacement of the first beam 106 constituting the actuating portion is made to be transmitted to the second beam 107 via a connecting portion 109, whereby the second beam 107 is displaced so as to be electrically connected to the wiring electrode 103 for implementation of switching. As this occurs, since the gap defined between the first beam 106 constituting the actuating portion and the first electrode is made smaller than the gap defined between the second beam 107 and the second electrode, a displacement amount of the second beam 107 until the electric connection is made becomes larger than the displacement of the first beam 106.

In addition, the actuating electrode 105 is formed on the substrate 101 below the first beam 106, so that electrostatic force is generated by applying voltage between the first beam 106 and the actuating electrode 105, whereby the beam is displaced. In addition, since the second beam 107 is displaced in a symmetrical fashion relative to a width direction of the beam, the first beam 106 is configured so as to be arranged on both sides of the second beam 107. As this occurs, the actuating electrode 105 is covered with an insulation membrane 104 made up of a silicon oxide membrane so as to prevent an electric contact between the first beam 106 and the actuating electrode 105, and electrostatic force is made to be generated with this insulation membrane 104 acting as a capacitive insulation membrane. Here, the actuating electrode 105 and the wiring electrode 103 constitute the same plane. In addition, the thickness of the insulation membrane 104 is in the order of 200 nm to several tim, and the difference in magnitude between the first and second gaps is made by the thickness of the insulation membrane 104.

The operation of the electromechanical switch described above will be explained as follows.

When the contact portion 107 is positioned apart from the wiring electrode 103 as is shown in FIGS. 2A and 2B, the switch is in an off state. When an electric field is applied between the first beam 106 and the actuating electrode 105, the first beam 106 is displaced by virtue of electrostatic force. As this occurs, by the first beam 106 being displaced as is shown in FIG. 2C, the second beam 107 can be displaced downwards. In this way, the second beam 107 is displaced to be connected to the wiring electrode 103, whereby the switch is put in an on state (FIG. 2D).

By this configuration, the actuating portion and the contact portion can be constructed to be separated from each other, and the displacement (force) of the actuating portion is transmitted to the contact portion through the connecting portion 109, whereby the contact portion can be displaced. As this occurs, since the actuating portion is constructed by the both-end fixed beam and the contact portion is constructed by the cantilevered beam, the displacement generated in the actuating portion can be magnified so as to allow the contact portion to be displaced largely. Thus, the advantage provided by the aforesaid configuration is large.

In addition, the gap defined between the first beam 106 constituting the actuating portion and the actuating electrode 105 is made smaller than the gap defined between the second beam 107 and the wiring electrode 103. By this configuration, an actuating voltage necessary for switching can be reduced or the switching speed can be made faster while ensuring a required electric isolation when the switch is on/off. Thus, the advantage provided by the above configuration is large.

Additionally, since the electric field necessary for actuation concentrates on the first beam 106 and the first electrode 105, even when the switch is used in small communication apparatus such as a mobile phone, there is caused no situation where the peripheral circuits are badly affected by the electric field. Furthermore, when the switch is actuated in the above described approach, since only the voltage is applied and no current is generated, no electric power is consumed by the actuation of the switch.

In addition, when the switch is configured to be actuated by the approach described above, the switch can be fabricated only through the standard CMOS process. Additionally, since the first electrode 105 and the second electrode 103 are made of the same material, not only can the fabrication of the switch be facilitated but also the actuation with lower voltage can be enabled by electrostatic force being allowed to act on not only the first electrode but also the second electrode.

Figure 3A:
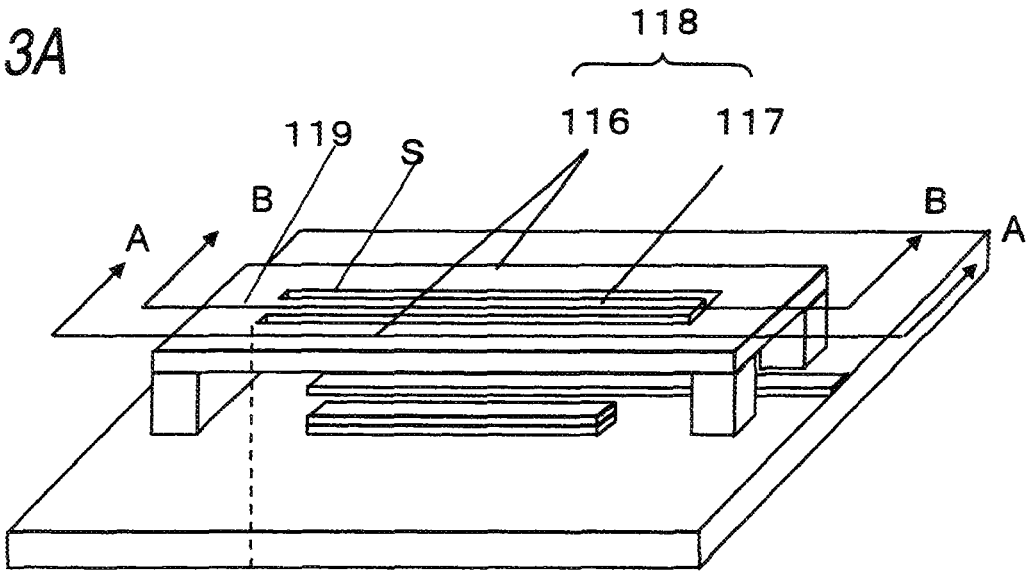
FIG. 3A is a perspective view of an electromechanical switch for explaining the position of a slit in the electromechanical switch according to Embodiment 1 of the invention.
Figure 3B:
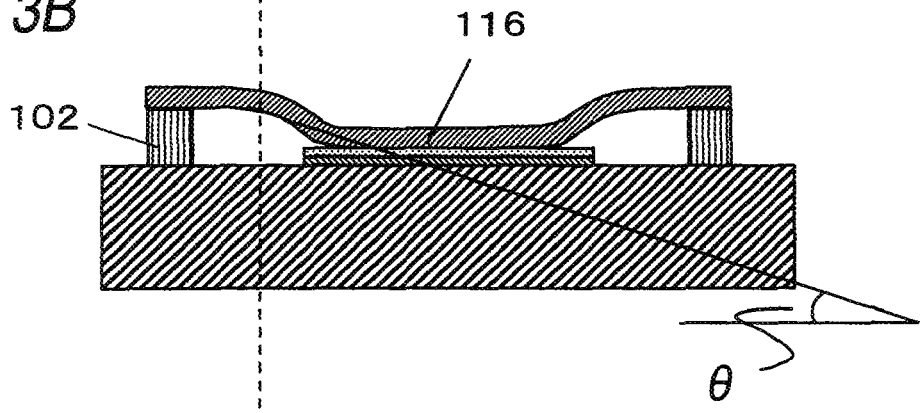
FIG. 3B is a sectional view of the switch taken along the line A-A.
Figure 3C:
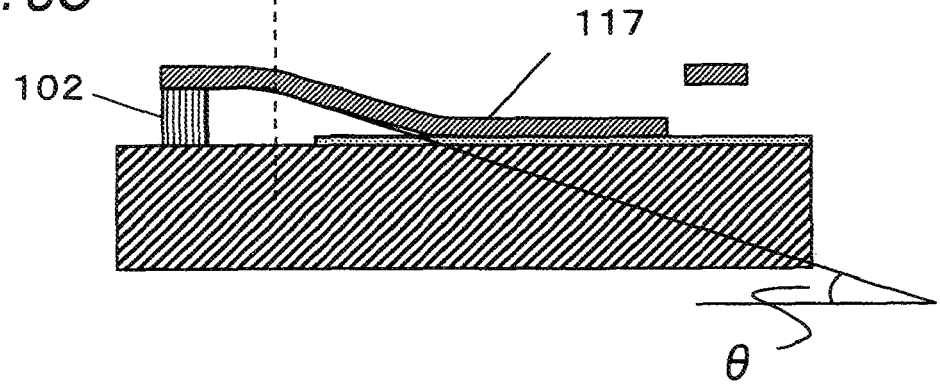
FIG. 3C is a sectional view of the switch taken along the line B-B.

The electromechanical switch of Embodiment 1 will be described further. Here, a relationship between the slit and the lengths of the actuating portion and the contact portion will be observed. FIGS. 3A to 3C show drawings which depict the position of a slit provided in an electromechanical switch of Embodiment 1 of the invention. FIG. 3A is a perspective view of the electromechanical switch, FIG. 3B is a sectional view of the electromechanical switch taken along the line A-A, and FIG. 3C is a sectional view of the electromechanical switch taken along the line B-B in FIG. 3A.

Here, a U-shaped slit S is desirably formed in an area which extends along three-fourth of a structural element 118. This is because in the event that the slit S is formed up to an area in the proximity of a support portion 102, a displacement (distortion) generated in a first beam 116 constituting the actuating portion cannot be transmitted sufficiently to a second beam 117 constituting the contact portion due to the effect of the support portion 102, and hence, a large displacement cannot be obtained. Note that in here, like reference numerals are imparted to like constituent portions to those shown in FIGS. 1 and 2.

Figure 4A:
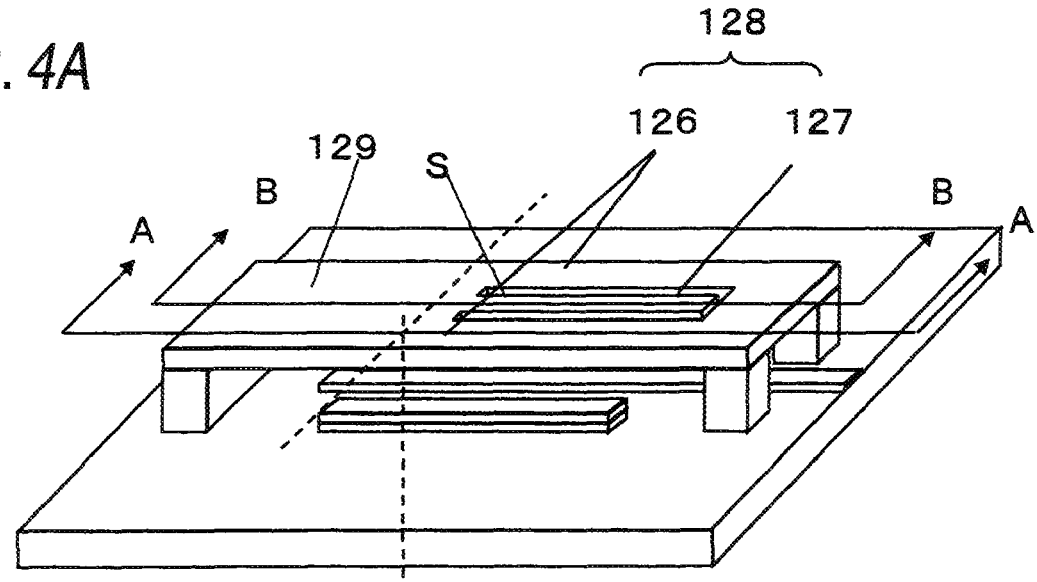
FIG. 4A is a perspective view of an electromechanical switch according to Embodiment 1 of the invention for explaining the position of a slit in the electromechanical switch.
Figure 4B:
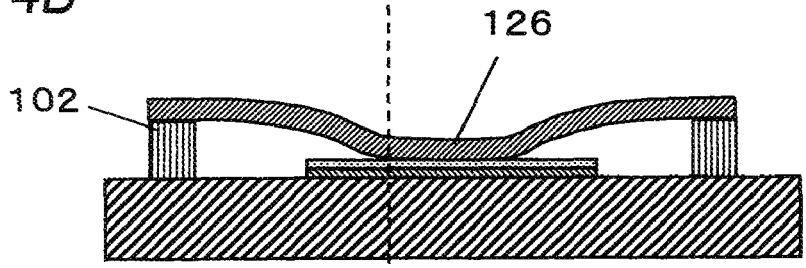
FIG. 4B is a sectional view of the switch taken along the line A-A.
Figure 4C:
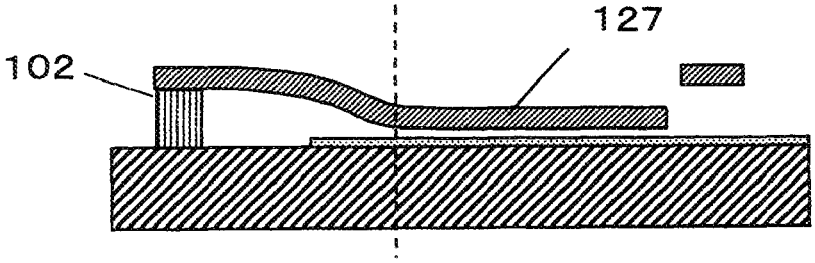
FIG. 4C is a sectional view of the switch taken along the line B-B.

In addition, FIGS. 4A to 4C show drawings which depict a case where a slit S is formed up to a portion in the proximity of a central portion of a structural element 128 of an electromechanical switch of Embodiment 1 of the invention. FIG. 4A is a perspective view of the electromechanical switch, FIG. 4B is a sectional view of the same switch taken along the line A-A and FIG. 4C is a sectional view of the switch taken along the line B-B in FIG. 4A. When the slit S is adopted which extends to the portion in the proximity of the central portion of the structural element 128, displacement is produced mainly in a first beam 126 which is a both-end fixed beam and which constitutes the actuating portion in a direction in which the first beam 126 is deflected, whereas the displacement of a second beam 127 which is a cantilevered beam and which constitutes the contact portion is restricted, and hence, the second beam 127 cannot be displaced largely. Furthermore, it is considered that the fact that the second beam 127 cannot be displaced largely may cause a fear that the second beam 127 is prevented from being electrically connected with a wiring electrode due to a difference in magnitude between a gap defined between the actuating portion and the actuating electrode and a gap defined between the contact portion and the wiring electrode. The first beam 126 and the second beam 127 are formed integrally via a connecting portion 129. Note that also in here, like reference numerals are imparted to like constituent portions to those shown in FIGS. 1A to 1C and FIGS. 2A to 2D.

Figure 5A:
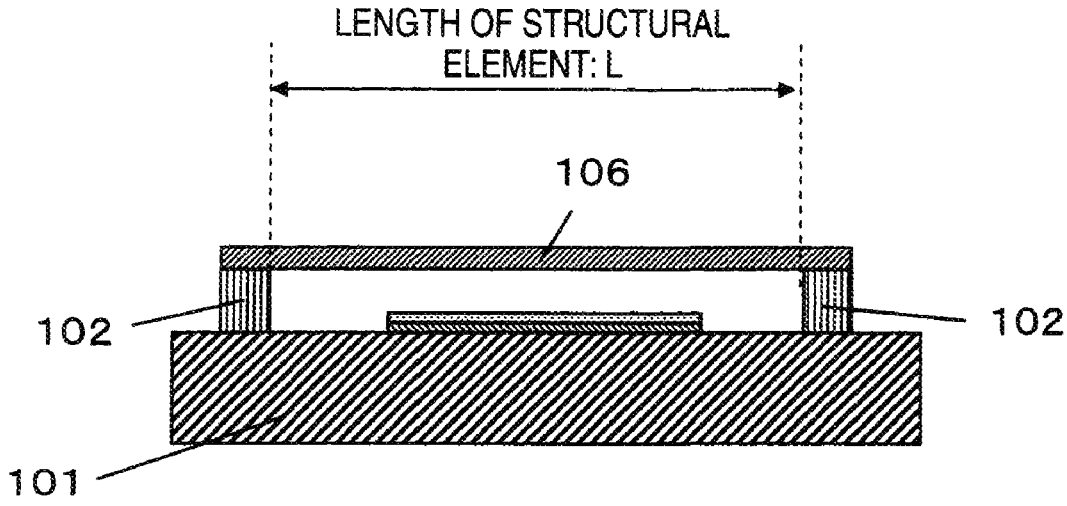
FIG. 5A is a diagram of an electromechanical switch for explaining the length of a structural element in the electromechanical switch according to Embodiment 1 of the invention.
Figure 5B:
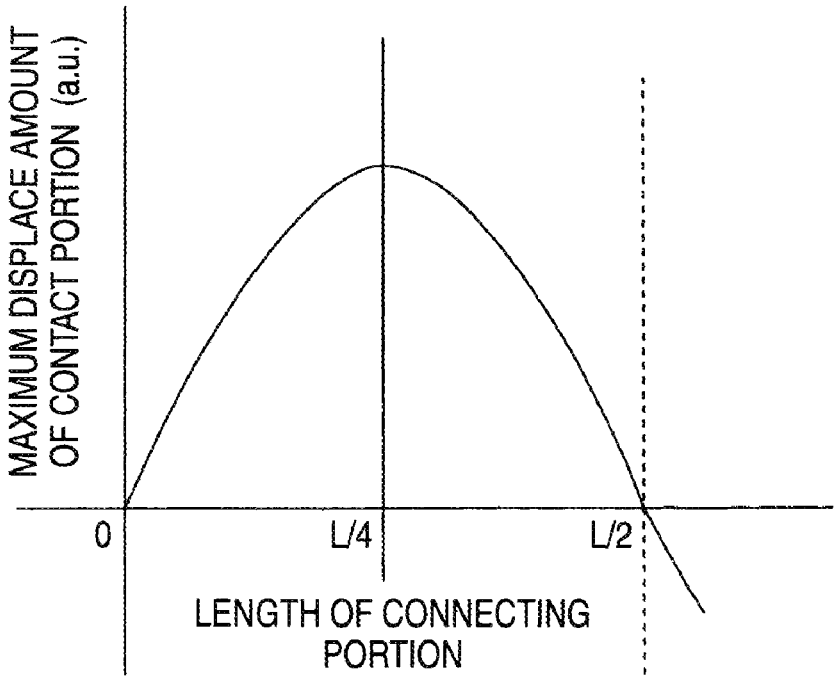
FIG. 5B is a diagram of the switch for explaining the length of a connecting portion and a displacement of a contact portion.

FIGS. 5A an 5B illustrate a relationship between the length of the connecting portion of the structural element of the electromechanical switch of Embodiment 1 of the invention and a maximum displacement amount of the contact portion. FIG. 5A is a drawing which depicts a length L of the structural element, and FIG. 5B is a graph showing a relationship between a length L of the connecting portion and a maximum displacement of the contact portion. A displacement direction identical to a direction in which the actuating portion is displaced is referred to a positive direction. As shown in the drawings, in the event that the length L of the connecting portion is in the range of one half or less of the length of the structural element, the contact portion can be displaced in the same direction in which the actuating portion is displaced. In addition, in the event that the length L of the connecting portion is one fourth of the length of the structural element, the displacement of the actuating portion can be transmitted to the contact portion with good efficiency so as to be transformed into a displacement of the contact portion, thereby making it possible to obtain a maximum displacement.

Note that in this embodiment, while the example is illustrated in which the gap defined between the actuating portion and the actuating electrode is made substantially different in magnitude from the gap defined between the contact portion and the wiring electrode by the insulation layer formed on the actuating electrode. However, the invention is not limited to the illustrated embodiment. A similar advantage can also be obtained by forming a recessed portion using a method of etching the substrate so as to provide a difference in level between the portion where the wiring electrode is formed and the portion where the actuating electrode is formed (FIGS. 6A to 6C and FIGS. 7A and 7B).

Figure 6A:
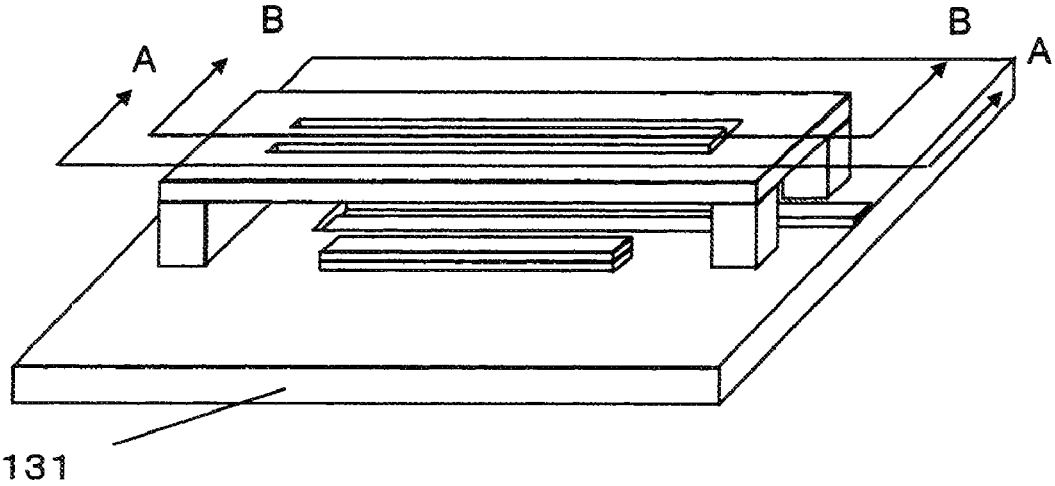
FIG. 6A is a perspective view of another electromechanical switch according to Embodiment 1 of the invention.
Figure 6B:
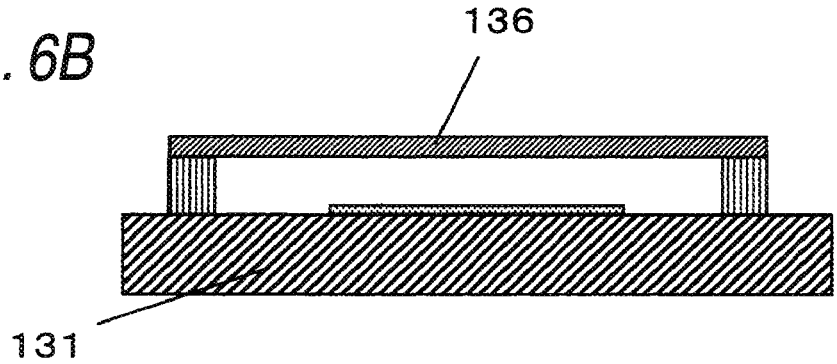
FIG. 6B is a sectional view of the another electromechanical switch in an off state taken along the line A-A.
Figure 6C:
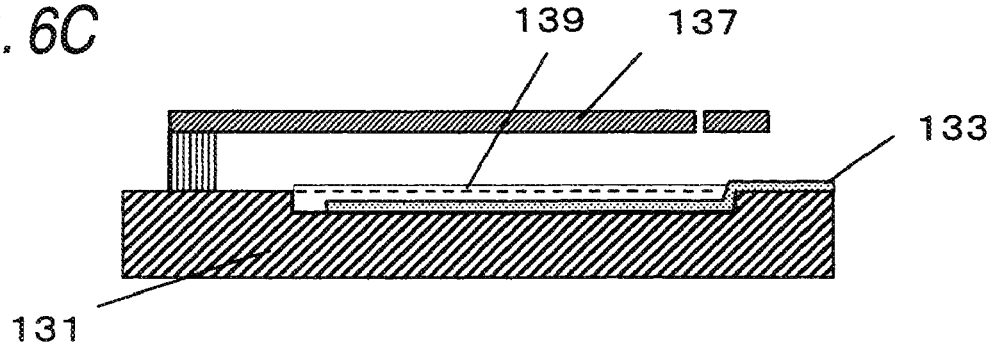
FIG. 6C is a sectional view of the another electromechanical switch in the off state taken along the line B-B.

FIGS. 6A to 6C show drawings which illustrate a modified example of an electromechanical switch according to Embodiment 1. FIG. 6A is a perspective view of a modified electromechanical switch, FIG. 6B is a sectional view of the electromechanical switch taken along the line A-A, and FIG. 6C is a sectional view of the electromechanical switch in an off state taken along the line B-B in FIG. 6A.

Figure 7A:
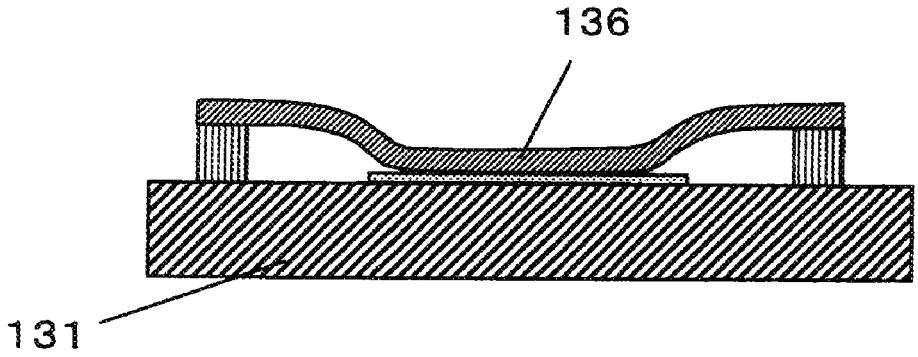
FIG. 7A is a sectional view of the electromechanical switch shown in FIG. 6 in an on state taken along the line A-A.
Figure 7B:
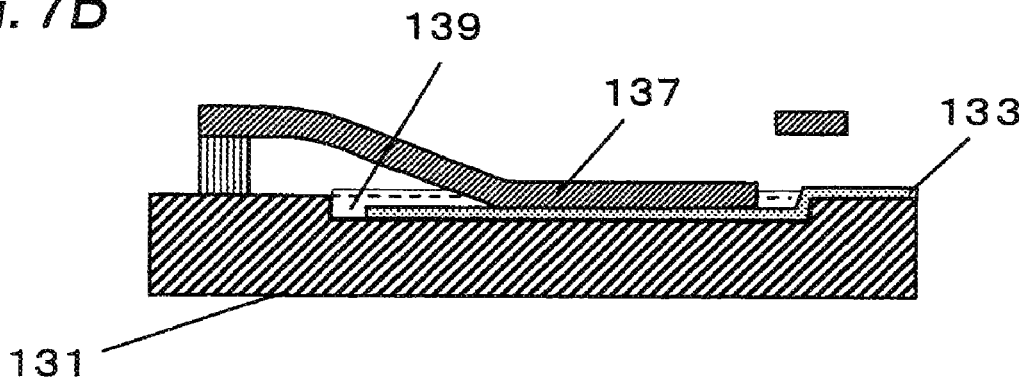
FIG. 7B is a sectional view of the electromechanical switch in an on state taken along the line B-B.

FIGS. 7A and 7B show sectional views which illustrate the modified electromechanical switch in an on state according to Embodiment 1. FIGS. 7A and 7B are sectional views showing the modified electromechanical switch in the on state and corresponding, respectively, to FIGS. 2C and 2D which show the state in which the first and second beams are displaced.

As is shown in the drawing, a wiring electrode 133 is formed in a recessed portion 139 which is formed on a surface of a substrate 131. The wiring electrode 133 includes a contact electrode constituting an abutment portion with which a second beam 137 as a contact portion is brought into abutment. Therefore, a difference in magnitude can be made between a gap defined between an actuating portion and an actuating electrode and a gap defined between the contact portion and the wiring electrode.

Figure 8A:
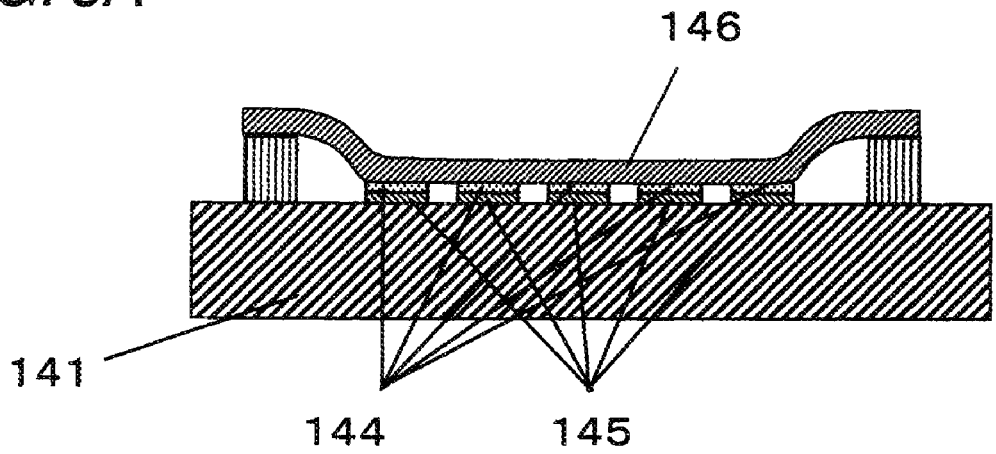
FIG. 8A is a sectional view of further another electromechanical switch in an on state taken along the line A-A.
Figure 8B:
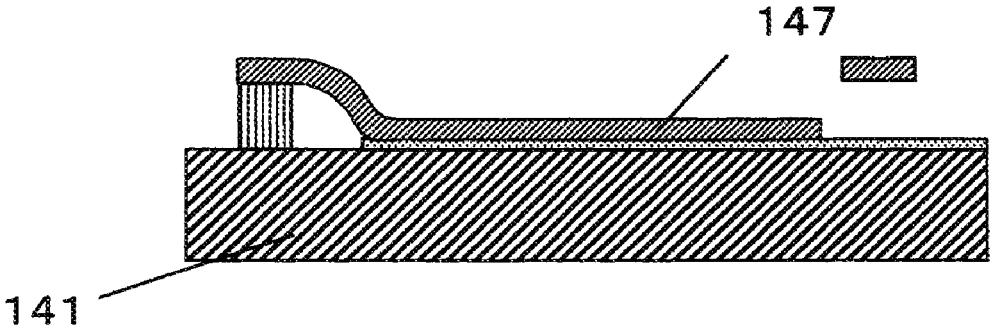
FIG. 8B is a sectional view of the further another electromechanical switch in an off state taken along the line B-B.

In addition, while in the embodiment, the example is described in which the one actuating electrode is formed, needless to say, the same advantage can be obtained even in the event that an actuating electrode is divided into a plurality of actuating electrode portions on a substrate 141 as shown in FIGS. 8A and 8B. FIGS. 8A and 8B are sectional views of a first beam 146 constituting the actuating portion and a second beam 147 constituting the contact portion when the switch is in the on state and correspond, respectively, to FIGS. 2C and 2D which show the state in which the first and second beams are displaced. Furthermore, electric field can be made to be applied uniformly to a plurality of areas by adopting the configuration in which the actuating electrode 144 is so divided. As a result of this, the actuating portion can be made to be displaced largely, the advantage of which becomes very large (FIGS. 8A and 8B). Note that surfaces of the actuating electrodes 144 are covered with insulation membranes 145.

(Embodiment 2)

Referring to FIGS. 9 and 10, Embodiment 2 will be described.

Figure 9A:
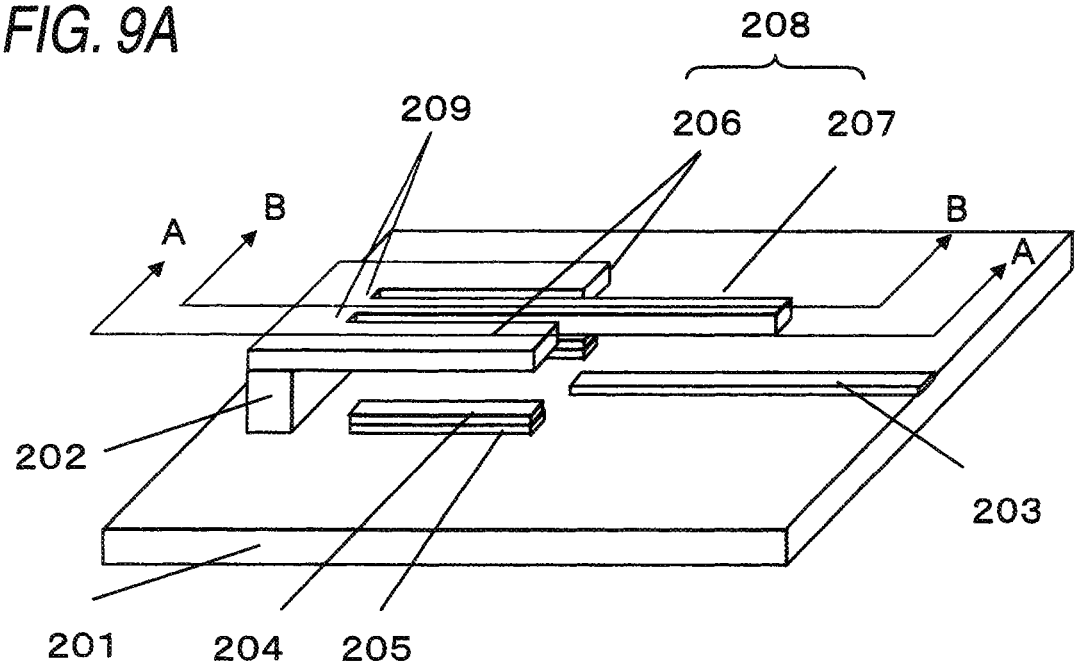
FIG. 9A is a perspective view of an electromechanical switch according to Embodiment 2 of the invention.
Figure 9B:
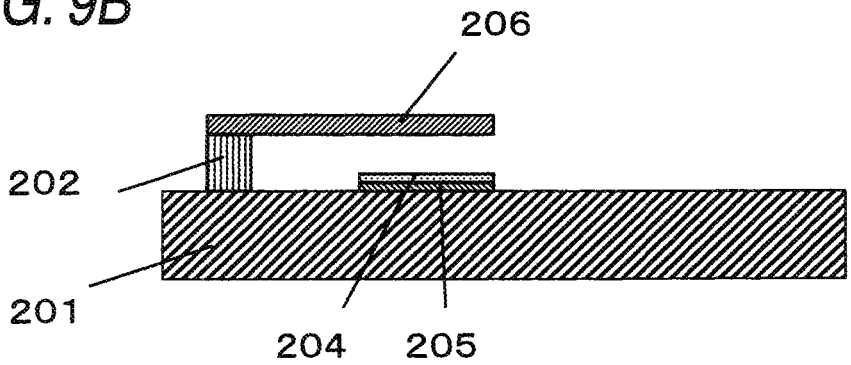
FIG. 9B is a sectional view of the electromechanical switch in an off state taken along the line A-A.
Figure 9C:
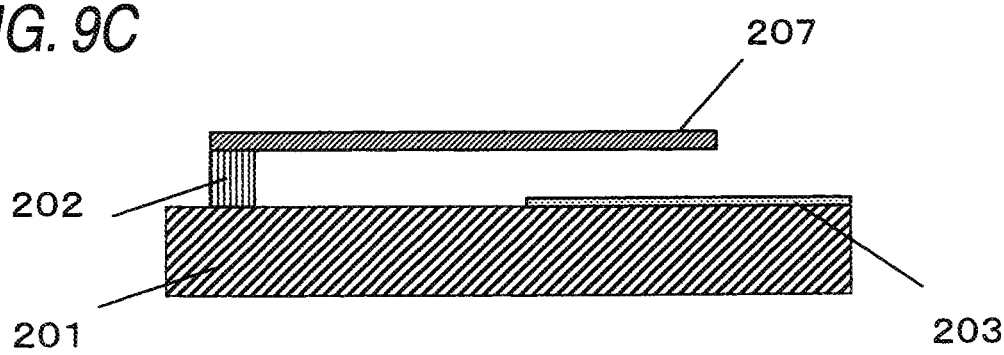
FIG. 9C is a sectional view of the electromechanical switch in an off state taken along the line B-B.
Figure 10A:
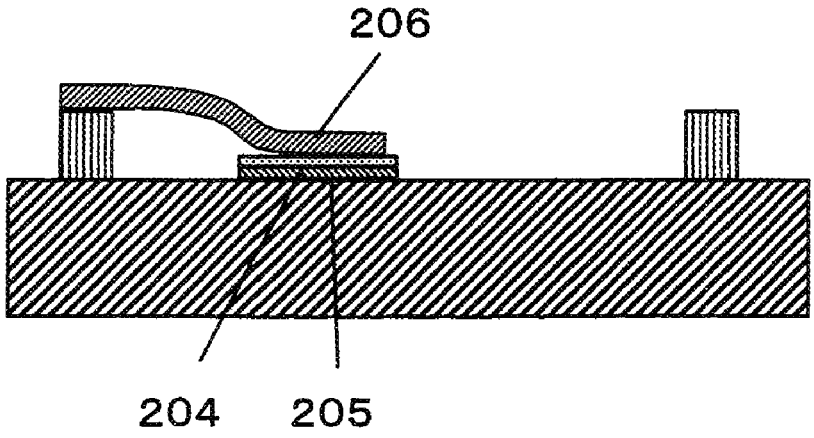
FIG. 10A is a sectional view of the electromechanical switch in an on state taken along the line A-A.
Figure 10B:
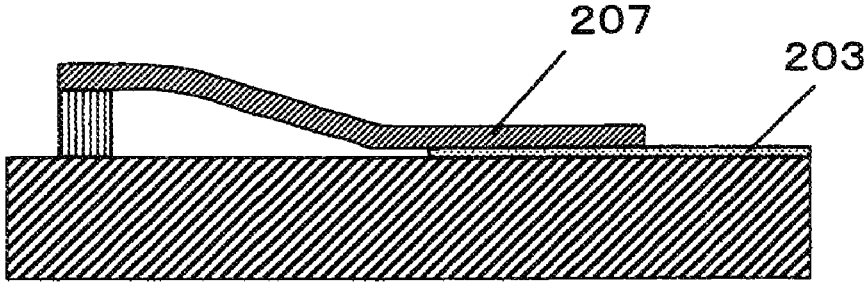
FIG. 10B is a sectional view of the electromechanical switch in an on state taken along the line B-B.

FIGS. 9A to 9C show drawings which illustrate an electromechanical switch according to Embodiment 2. FIG. 9A is a perspective view of the switch, FIG. 9B is a sectional view of the switch taken along the line A-A, and FIG. 9C is a sectional view of the switch taken along the line B-B in FIG. 9A. The electromechanical switch shown in FIGS. 9A to 9C are in an off state. In addition, FIGS. 10A, 10B show sectional views which illustrate the electromechanical switch in an on state.

As is shown in FIG. 9A, this embodiment is characterized in that both a first beam 206 constituting an actuating portion and a second beam 207 constituting a contact portion are made up of cantilevered beams. Reference numeral 201 denotes a substrate in which constituent elements of the electromechanical switch of the embodiment are incorporated. Also, in this embodiment, silicon, gallium arsenic, SiC and the like can be used as materials for the substrate. A support portion 202 is provided on the substrate 201 for supporting a structural element 208. The structural element 208 is constructed to be made up of three beams which are connected together in such a manner that two short beams 206 are formed on both sides of a longest beam 207. The two short beams make up the first beam 206, and the long beam makes up the second beam 207, the first beam 206 and the second beam 207 being then connected together by a connecting portion 209. The second beam 207 is electrically connected with a wiring electrode 203 formed on the substrate 201, whereby switching is implemented. In addition, an actuating electrode 205 is formed on the substrate 201 below the first beam 206 which make up the actuating portion, and electrostatic force is produced by applying voltage between the first beam 206 and the actuating electrode 205, whereby the beam is displaced. By the first beam 206 formed on both the sides of the second beam 207, a displacement (distortion) in the first beam 206 is transmitted therefrom in a symmetrical fashion to the second beam 207. The actuating electrode 205 is covered with an insulation membrane 204 so as to prevent the first beam 206 from being electrically connected to the actuating electrode 205 as the displacement is so transmitted, and electrostatic force is made to be generated using the insulation membrane 204 as a capacitive insulation membrane.

The Embodiment 2 differs from Embodiment 1 in that the first beam 206 is formed as not a beam which is fixed at both ends thereof but a beam which is fixed at only one end thereof or a cantilevered beam.

The operation of the electromechanical switch according to Embodiment 2 will be described.

Firstly, as shown in FIGS. 9B and 9C, when the second beam 207 is positioned apart from the wiring electrode 203, the electromechanical switch is in an off state. When an electric field is applied between the first beam 206 and the actuating electrode 205, the first beam 206 is displaced by virtue of electrostatic force produced as a result of the application of the electric field. As this occurs, by the displacement of the first beam 206 as shown in FIG. 10A, the second beam 207 constituting the contact portion can be displaced downwards. Since the second beam 207 is displaced so as to contact with the wiring electrode 203, the electromechanical switch is turned in an on state (FIG. 10B).

By adopting the configuration described above, the construction can be realized in which the actuating portion and the contact portion are separated from each other, whereby a displacement (distortion) in the actuating portion can be transmitted to the contact portion through the connecting portion so as to displace the contact portion. As this occurs, since the length of the actuating portion differs from the length of the contact portion, a small displacement produced in the actuating portion can be magnified so that a large displacement is produced in the contact portion. Namely, in the event that a gap 1 defined between the actuating portion and the actuating electrode is made to differ in magnitude from a gap 2 defined between the contact portion and the wiring electrode, even when the gap 1<the gap 2, the displacement produced in the actuating portion can be magnified to produce a large displacement in the contact portion, the advantage of which is large.

(Embodiment 3)

Figure 11:
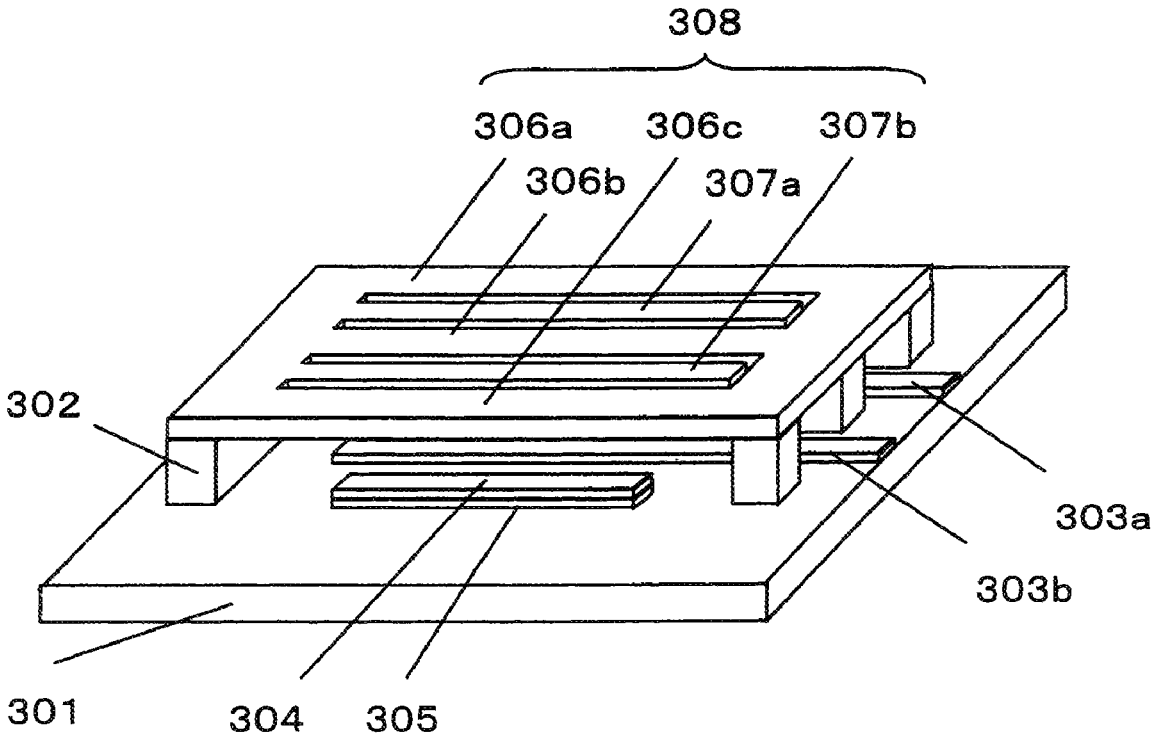
FIG. 11 is a sectional view of an electromechanical switch according to Embodiment 3 of the invention.

Referring to FIG. 11, Embodiment 3 will be described.

FIG. 11 is a perspective view showing an electromechanical switch according to Embodiment 3. FIG. 11 shows a construction that a plurality of electromechanical switches described in Embodiment 1 can be switched therebetween.

The Embodiment 3 differs from Embodiment 1 and Embodiment 2 in that actuating portions 306 are formed at three locations and contact portions 307 are formed at two locations, and the other features and the operation principle of the embodiment remain the same as those of Embodiments 1 and 2.

By forming the electromechanical switch in described above, two signals can be used while being switched. In addition, when attempting to implement switching between a plurality of signals, this can be attained by forming as many contact portions as the number of switches (with a plurality of actuating portions required to be formed in accordance with the formation of contact portions).

(Embodiment 4)

Figure 12:
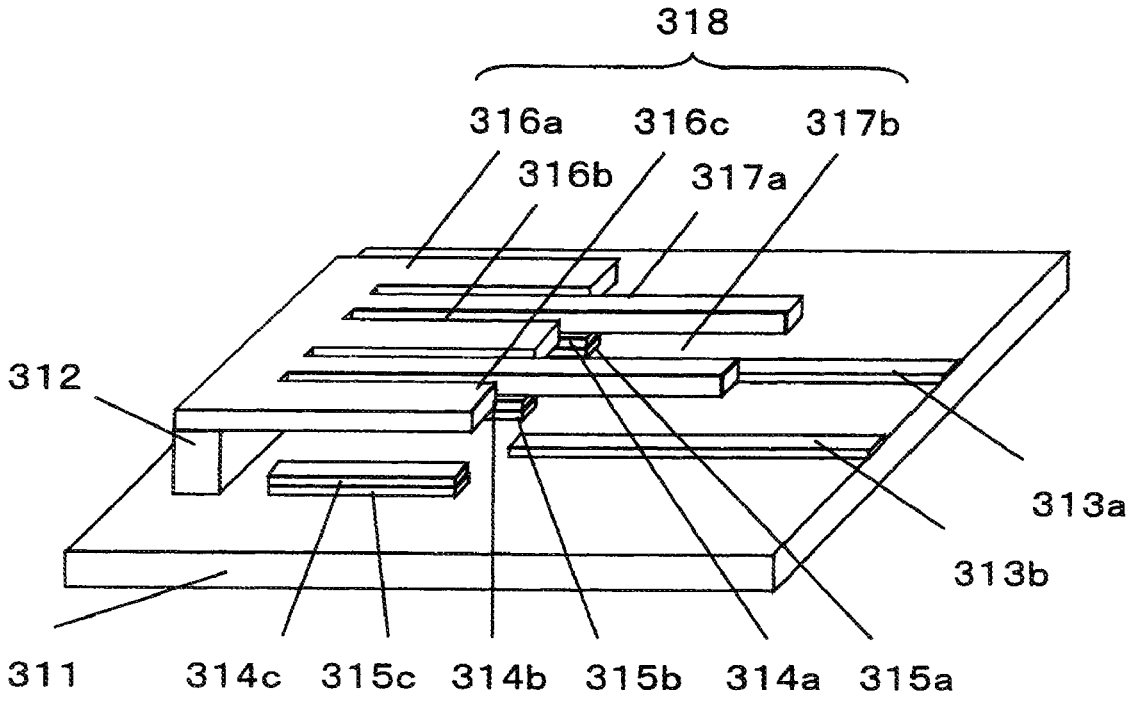
FIG. 12 is a sectional view of an electromechanical switch according to Embodiment 4 of the invention.

Referring to FIG. 12, Embodiment 4 will be described.

FIG. 12 is a perspective view showing an electromechanical switch according to Embodiment 4. FIG. 12 shows a construction in which the electromechanical switches according to Embodiment 2 can be switched.

This embodiment also differs from Embodiment 2 in that actuating portions 316 are formed at three locations and contact portions 317 are formed at two locations, and the other features and the operation principle of the embodiment remain the same as those of Embodiment 2.

By forming the electromechanical switch in the manner described above, two signals can be used while being switched. In addition, when attempting to implement switching between a plurality of signals, this can be attained by forming as many contact portions as the number of switches (with a plurality of actuating portions required to be formed in accordance with the formation of contact portions).

(Embodiment 5)

Figure 13A:
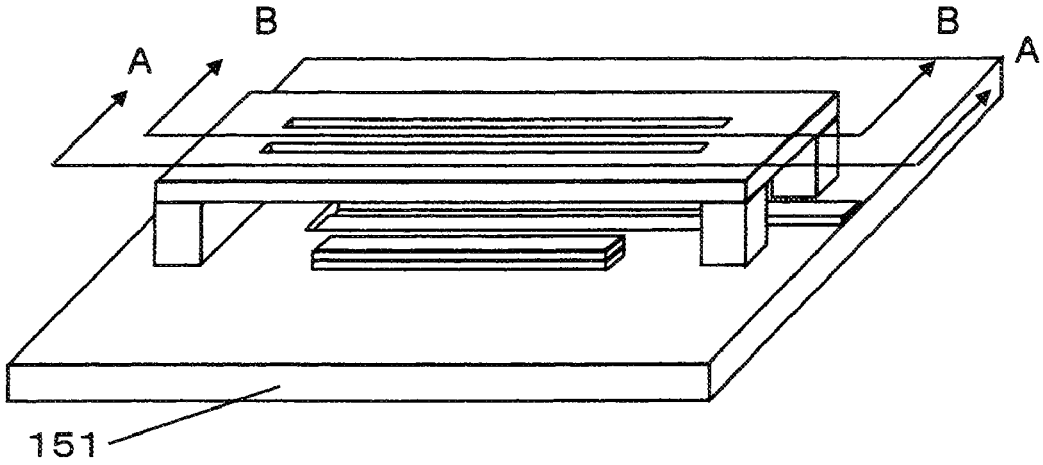
FIG. 13A is a perspective view of an electromechanical switch according to Embodiment 5 of the invention.
Figure 13B:
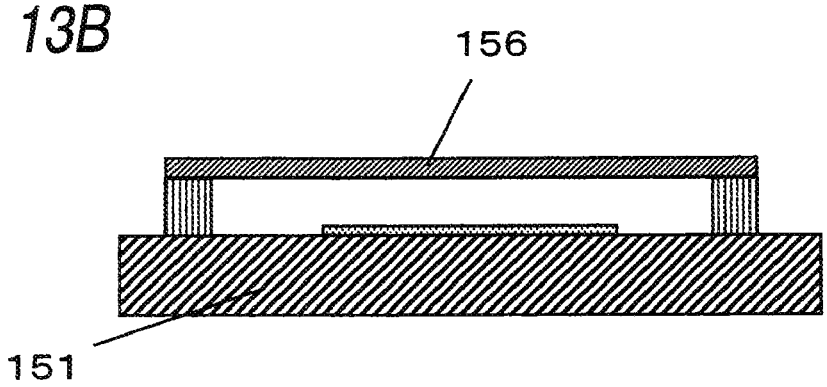
FIG. 13B is a sectional view of the electromechanical switch taken along the line A-A.
Figure 13C:
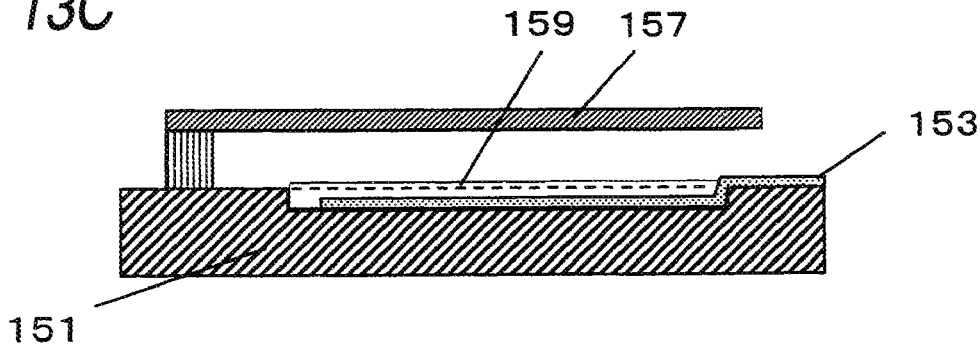
FIG. 13C is a sectional view of the electromechanical switch taken along the line B-B.

Referring to FIGS. 13A to 13C, Embodiment 5 will be described.

FIGS. 13A to 13C show drawings which depict an electromechanical switch according to Embodiment 5. FIG. 13A is a perspective view of the switch, FIG. 13B is a sectional view of the switch taken along the line A-A, and FIG. 13C is a sectional view of the switch taken along the line B-B in FIG.

Figure 14A:
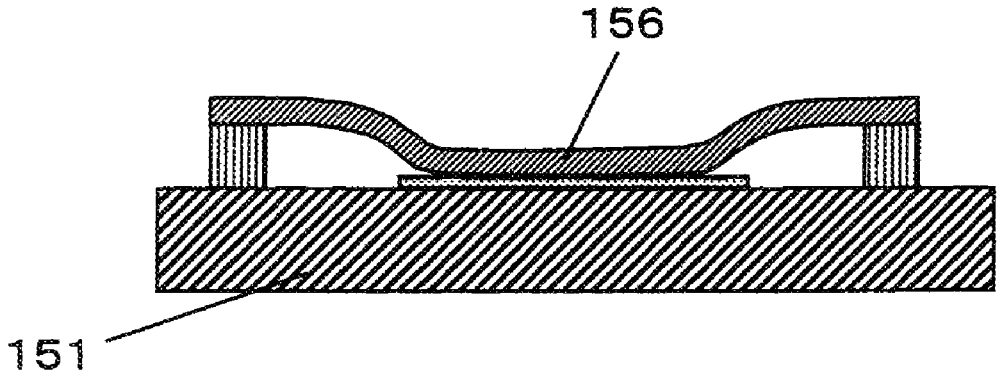
FIG. 14A is a sectional view showing the electromechanical switch in an off state depicted in FIGS. 13A to 13C.
Figure 14B:
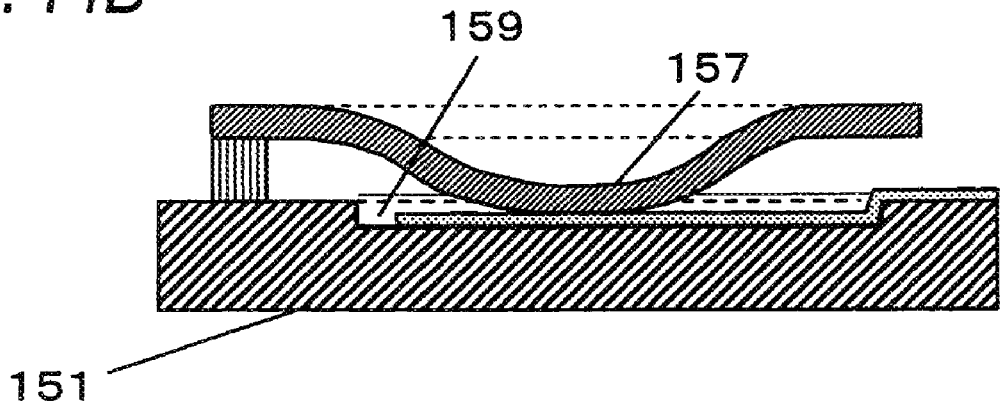
FIG. 14B is a sectional view showing the electromechanical switch in an on state depicted in FIGS. 13A to 13C.

13A. In the drawings, the switch is in an off state. In addition, FIGS. 14A and 14B show sectional views of the electromagnetic switch in an on state.

This embodiment differs from Embodiment 1 in that a second beam 157 constituting a contact portion is made up of a beam which is fixed at both ends thereof while in Embodiment 1, the second beam constituting the contact portion was made up of the cantilevered beam. In addition, in this embodiment, a second electrode which faces to the second beam 157 is formed in a recessed portion 159 which is formed on a surface of a substrate, and a second gap defined between the second beam and the second electrode is made larger than a first gap defined by a first electrode and an actuating portion.

Namely, as with those described in Embodiments 1 to 4, the electromechanical switch of this embodiment is fabricated through the MEMS process using a silicon substrate 1 as a constituent material. The electromechanical switch includes a first beam 156 which is made up of two both-end fixed beams and which constitute the actuating portion and the second beam 157 which is made up of the both-end fixed beam and which constitutes the contact portion. The first beam 156 and the second beam 157 are placed in parallel in such a way that the second beam 157 is held between the two beams of the first beam 156. In addition, the electromechanical switch further includes the first electrode 155 which is formed as an actuating electrode for the first beam 156 via the first gap and the second electrode 153 which is formed as a wiring electrode for the second beam 157 via the second gap, and the second gap is made larger than the first gap.

The operation of the above electromechanical switch will be described.

As is shown in FIGS. 13B and 13C, when the second beam 157 is positioned apart from the wiring electrode 153, the electromechanical switch is in the off state. When an electric field is applied between the first beam 156 and the actuating electrode 155, the first beam 156 is displaced by virtue of electrostatic force as is shown in FIG. 14A. The second beam 157 can be displaced downwards by the first beam 156. As a result, the second beam 157 is connected to the wiring electrode 153, and the electromechanical switch is turned to the on state (FIG. 14B).

The actuating portion and the contact portion can be constructed to be separated from each other by adopting the configuration described above, and a displacement (distortion) of the actuating portion is transmitted to the contact portion via a connecting portion 109. Thereby, the contact portion can be displaced. As this occurs, since the actuating portion and the contact portion are constructed to be fixed at both the ends thereof, a stable operation is ensured, In addition, a small displacement produced in the actuating portion which is made up of the two beams lying on both sides of the contact portion is transmitted to the contact portion in a magnified fashion, whereby a large displacement can be produced in the contact portion.

In addition, the gap defined between the first beam 156 and the actuating electrode 155 is made smaller than the gap defined between the contact portion 157 and the wiring electrode 163. By adopting this configuration, an actuating voltage necessary for switching can be reduced or the switching speed can be made faster while ensuring a required isolation when the switch is on/off, thus a large advantage being provided in utilizing the switch.

(Embodiment 6)

Figure 15A:
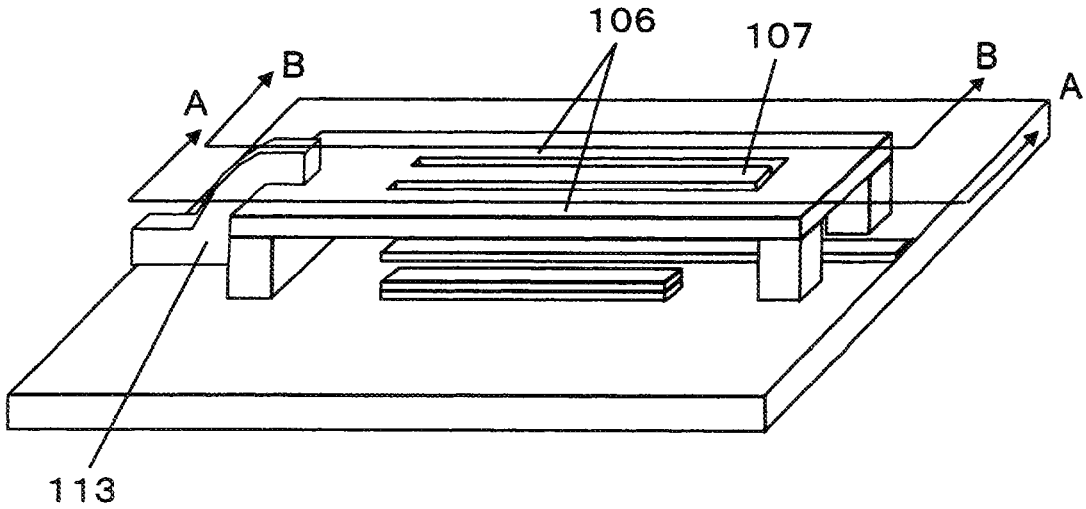
FIG. 15A is a perspective view of an electromechanical switch according to Embodiment 6 of the invention for explaining the position of a slit in the electromechanical switch.
Figure 15B:
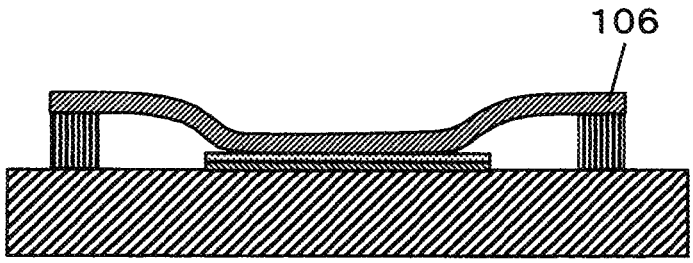
FIG. 15B is a sectional view of the switch taken along the line A-A.
Figure 15C:
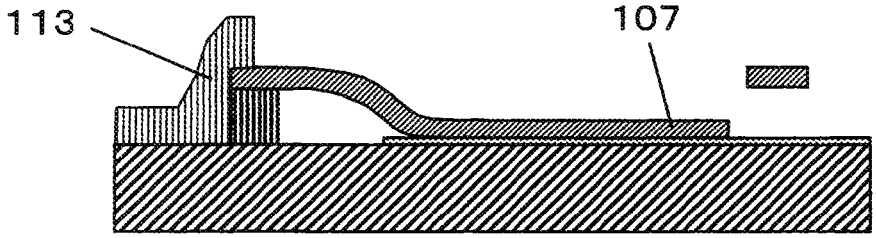
FIG. 15C is a sectional view of the switch taken along the line B-B.

Referring to FIGS. 15A to 15C, Embodiment 6 will be described.

FIGS. 15A to 15C show drawings which depict an electromechanical switch according to Embodiment 6. FIG. 15A is a perspective view of the switch, FIG. 15B is a sectional view of the switch taken along the line A-A, and FIG. 15C is a sectional view of the switch taken along the line B-B in FIG. 15A. In the drawings, FIGS. 15B and 15C show sectional views of the electromechanical switch in an on state.

Here, a power feeding method to an electrode will be described, and in this embodiment, after a structural element has been fabricated, a wiring electrode 113 is finally formed on a top layer lying on a first beam 106 constituting an actuating portion and a contact portion 107 with an aluminum wiring pattern.

Energization can be facilitated by this configuration.

(Embodiment 7)

Figure 16A:
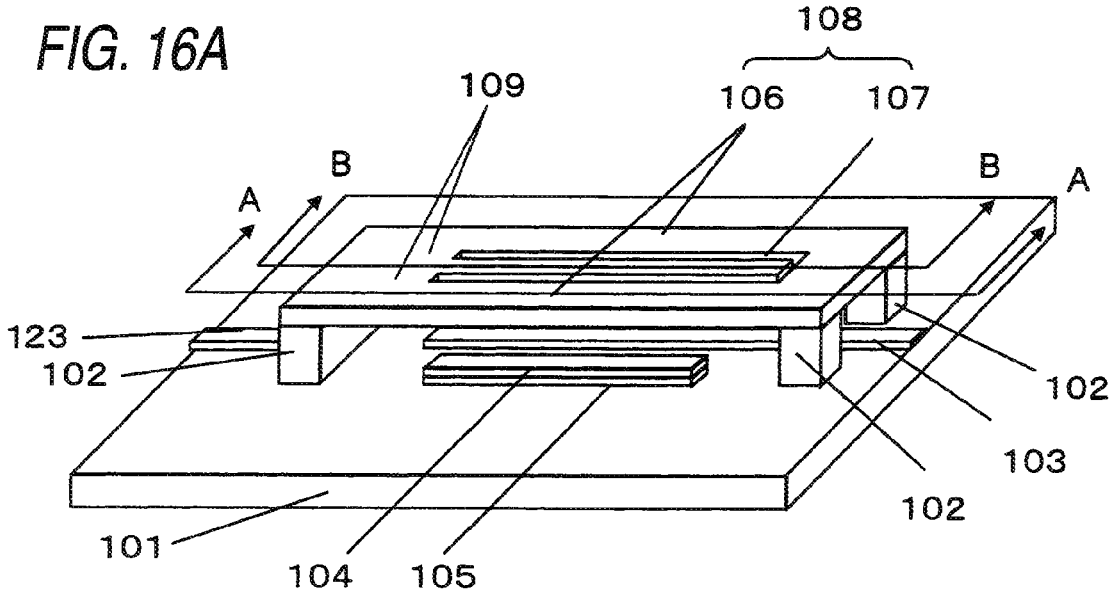
FIG. 16A is a perspective view of an electromechanical switch according to Embodiment 7 of the invention for explaining the position of a slit in the electromechanical switch.
Figure 16B:
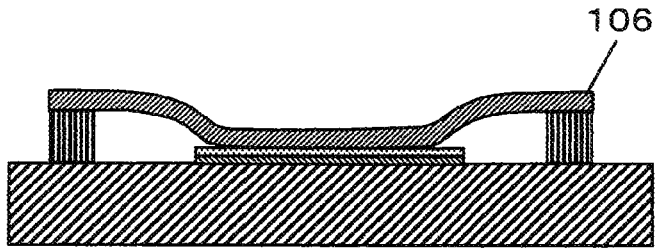
FIG. 16B is a sectional view of the switch taken along the line A-A.
Figure 16C:
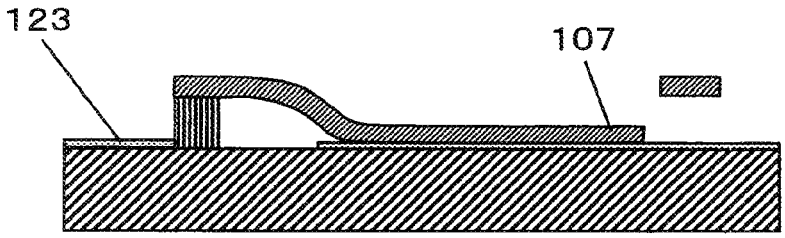
FIG. 16C is a sectional view of the switch taken along the line B-B.

Referring to FIGS. 16A to 16C, Embodiment 7 will be described.

FIGS. 16A to 16C show drawings which depict an electromechanical switch according to Embodiment 7. FIG. 16A is a perspective view of the switch, FIG. 16B is a sectional view of the switch taken along the line A-A, and FIG. 16C is a sectional view of the switch taken along the line B-B in FIG. 16A. In the drawings, FIGS. 16B and 16C show sectional views of the electromagnetic switch in an on state.

Here, a power feeding method to an electrode will be described, and in this embodiment, a feeding portion is formed at the same time as a wiring electrode 103 is formed, and support elements 102S are made of a conductive material such as doped polysilicone.

According to this configuration, a step of forming an energization portion and a step of forming a wiring electrode are made to occur at the same time, thereby making it possible to reduce the number of fabrication man-hours for simplified fabrication.

(Embodiment 8)

Next, Embodiment 8 of the invention will be described by reference to FIGS. 17A to 17C and FIGS. 18A and 18B.

Figure 17A:
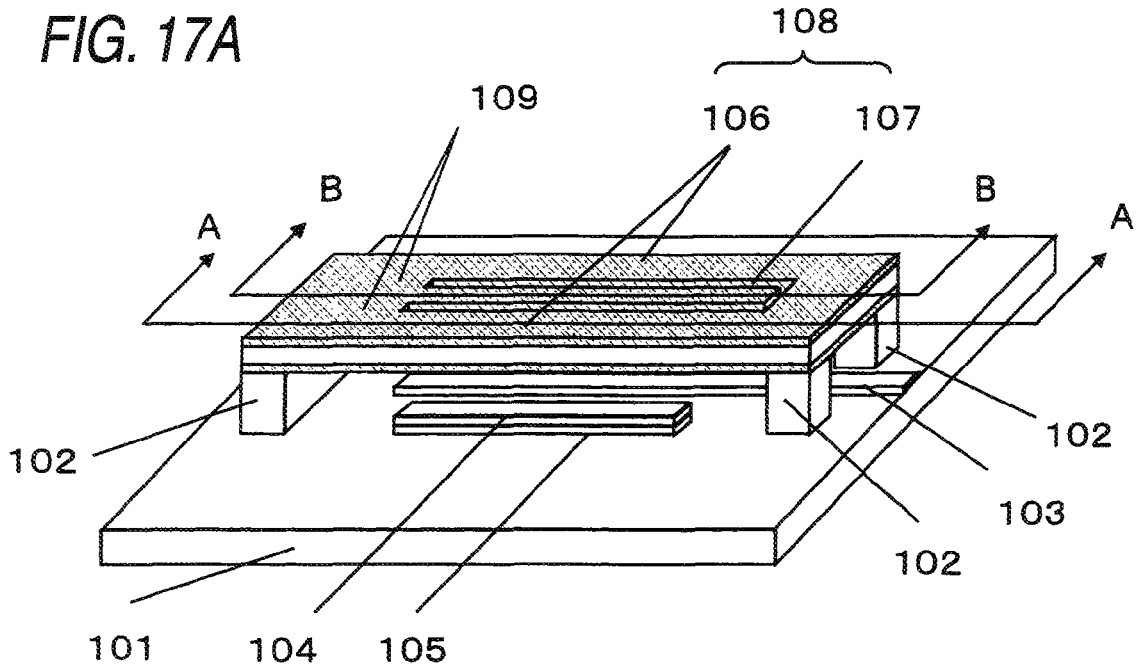
FIG. 17A is a perspective view of an electromechanical switch according to Embodiment 8 of the invention.
Figure 17B:
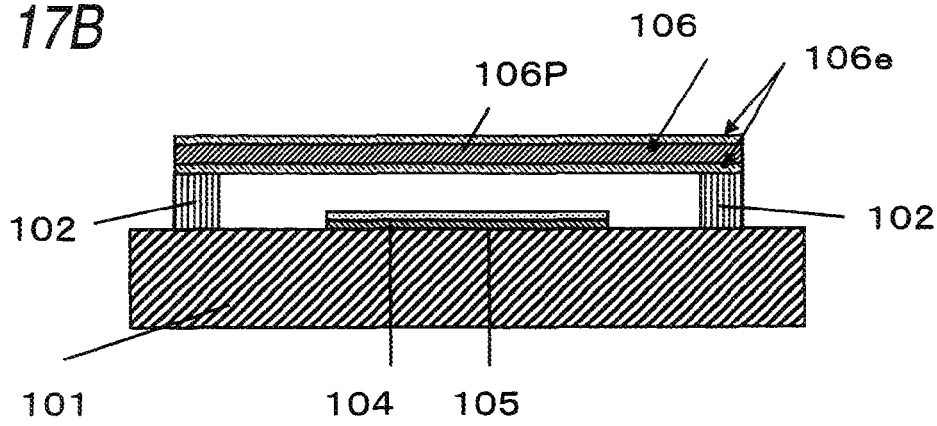
FIG. 17B is a sectional view of the electromechanical switch in an off state taken along the line A-A of FIG. 17A.
Figure 17C:
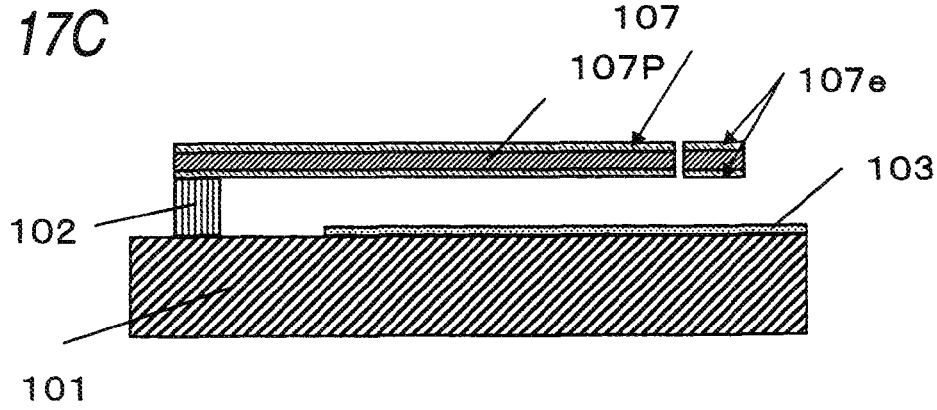
FIG. 17C is a sectional view of the electromechanical switch in an off state taken along the line B-B of FIG. 17A.
Figure 18A:
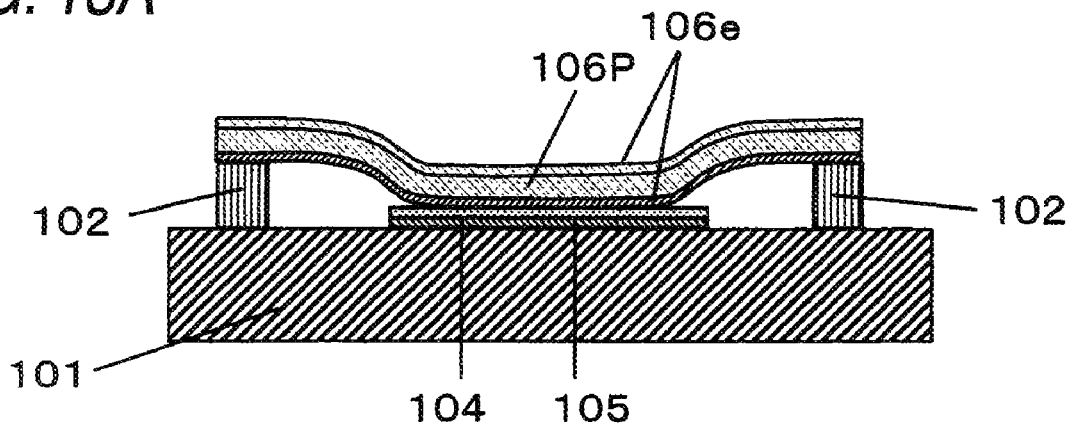
FIG. 18A is a sectional view of the electromechanical switch in an on state taken along the line A-A.
Figure 18B:
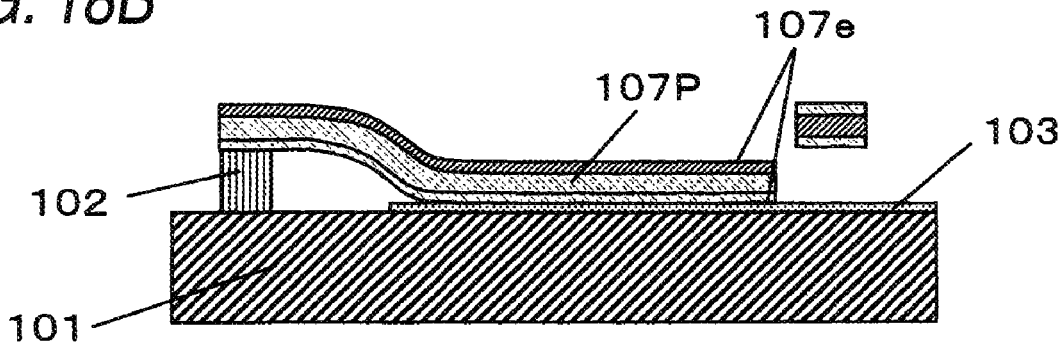
FIG. 18B is a sectional view of the electromechanical switch in an on state taken along the line B-B.

FIGS. 17A to 17C show drawings of a electromechanical switch according to Embodiment 8. FIG. 17A is a perspective view of the electromechanical switch, FIG. 17B is a sectional view of the electromechanical switch in an off state taken along the line A-A, and FIG. 17C is a sectional view of the electromechanical switch in the off sate taken along the line B-B in FIG. 17A. In addition, FIG. 18A is a sectional view of the electromechanical switch in an on state taken along the line A-A and FIG. 18B is a sectional view of the electromechanical switch in the on state taken along the line B-B in FIG. 17A.

The electromechanical switch of this embodiment differs from that in Embodiment 1 in that the first and second beams 106, 107 are actuated not only by electrostatic force but also by making use of piezoelectric effect since piezo electric thin films 106P, 107P are held by electrodes 106*e*, 107*e*, respectively.

Referring to FIG. 17A, reference numeral 101 denotes a substrate into which constituent elements of a micromachine device are incorporated. Silicone, gallium arsenic, SiC and the like can be used as materials for the substrate. Support portions 102 are provided on the substrate 101 as spacers which support a structural element 108 on the substrate 101 with a predetermined gap provided therebetween. The structural element 108 is configured by disposing metallic thin films which make up electrodes on upper and lower sides of piezoelectric thin films. A U-shaped slit is provided in the structural element 108 so as to divide the structural element 108 into a first beam 106 which makes up an actuating portion and a second beam 107 which makes up a contact portion, and the first beam 106 is constructed as the both-end fixed beam, while the second beam 107 is constructed as the cantilevered beam, The displacement of the first beam 106 is made to be transmitted to the second beam 107 via a connecting portion 109, whereby the second beam 107 is displaced so as to be electrically connected to a wiring electrode 103 for implementation of switching. As this occurs, since a gap defined between the first beam 106 which makes up the actuating portion and a first electrode is made smaller than a gap defined between the second beam 107 which makes up the contact portion and a second electrode, a displacement amount of the second beam 107 until the electric connection is made becomes larger than the displacement of the first beam 106.

In addition, an actuating electrode 105 is formed on the substrate 101 below the first beam 106, so that electrostatic force is generated by applying voltage between the first beam 106 and the actuating electrode 105. Furthermore, in this embodiment, distortion due to piezoelectric effect is generated by applying voltage between the electrodes disposed on the upper and lower sides of the piezoelectric thin film. The beams are displaced by virtue of the electrostatic force and the distortion based on the piezoelectric effect.

On and off operations of the electromechanical switch are similar to those of Embodiment 1.

Thus, by the electromechanical switch, in addition to the advantage described in Embodiment 1, an advantage can also be provided that the electromechanical switch of the embodiment can be actuated with a lower voltage and at higher speeds compared with the case where the same switch would be actuated only by electrostatic force.

(Embodiment 9)

Figure 19:
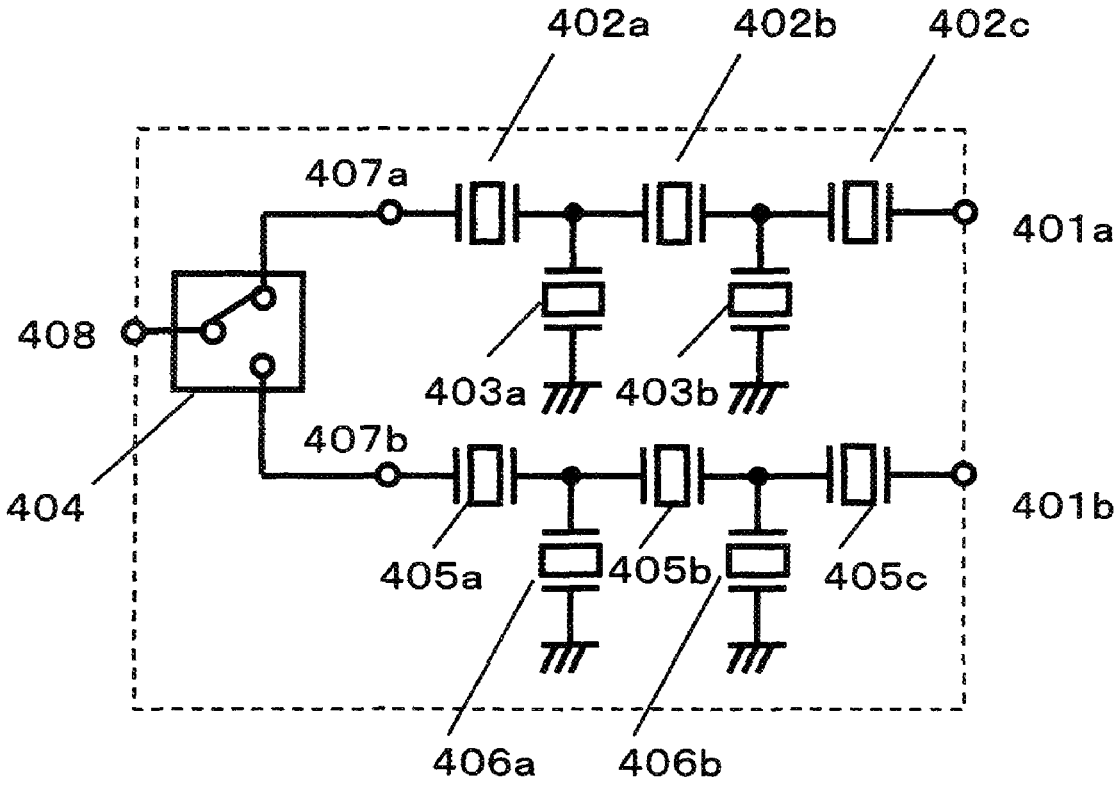
FIG. 19 is block diagram of a filter according to Embodiment 9 of the invention.

FIG. 19 is a drawing showing the configuration of a filter according to Embodiment 9. In FIG. 19, an example of a frequency switching filter including an electromechanical switch and a piezoelectric thin film resonator filter will be shown.

Piezoelectric thin film resonators 402*a*, 402*b*, 402*c* are connected in series between a terminal 407*a* and a terminal 401*a*. Piezoelectric thin film resonators 403*a* and 403*b* are connected, respectively, between a connection point between the piezoelectric thin film resonators 402*a* and 402*b* and a ground potential and between a connection point between the piezoelectric thin film resonators 402*b* and 402*c* and a ground potential. Similarly, Piezoelectric thin film resonators 405*a*, 405*b*, 405*c* are connected in series between a terminal 407*b* and a terminal 401*b*. Piezoelectric thin film resonators 406*a* and 406*b* are connected, respectively, between a connection point between the piezoelectric thin film resonators 405*a* and 405*b* and a ground potential and between a connection point between the piezoelectric thin film resonators 405*b* and 405*c* and a ground potential.

The terminals 407*a* and 407*b* are connected, respectively, to different terminals of an electromechanical switch 404. In addition, the other terminal of the electromechanical switch is connected to a terminal 408.

Next, the operation of the above described frequency switching filter will be described.

The electromechanical switch 404 performs the same operation of the electromechanical switch shown in Embodiment 3 and includes two wiring electrodes. The terminal 407*a* or 407*b* is connected with the terminal 408 by switching. When the terminal 408 is connected with the terminal 407*a*, a signal is allowed to pass through the terminal 408 and the terminal 401*a*. Conversely, when the terminal 408 is connected with the terminal 407*b*, the signal is allowed to pass through the terminal 408 and the terminal 401*b*.

As this occurs, for example, by differentiating the frequency characteristic of the filter which is made up of the piezoelectric thin film resonators 402*a*, 402*b*, 402*c*, 403*a*, 403*b* from the frequency characteristic of the filter made up of the piezoelectric thin film resonators 405*a*, 405*b*, 405*c*, 406*a*, 406*b*, a frequency variable filter can be realized which can cope with a plurality of frequency bands.

In addition, while in the embodiment, as the example, the filter is described as being made up of the piezoelectric thin film resonators, even in the event that 402*a*, 402*b*, 402*c*, 403*a*, 403*b* are made up of elastic surface wave filters, a similar advantage can, needless to say, be obtained.

(Embodiment 10)

Figure 20:
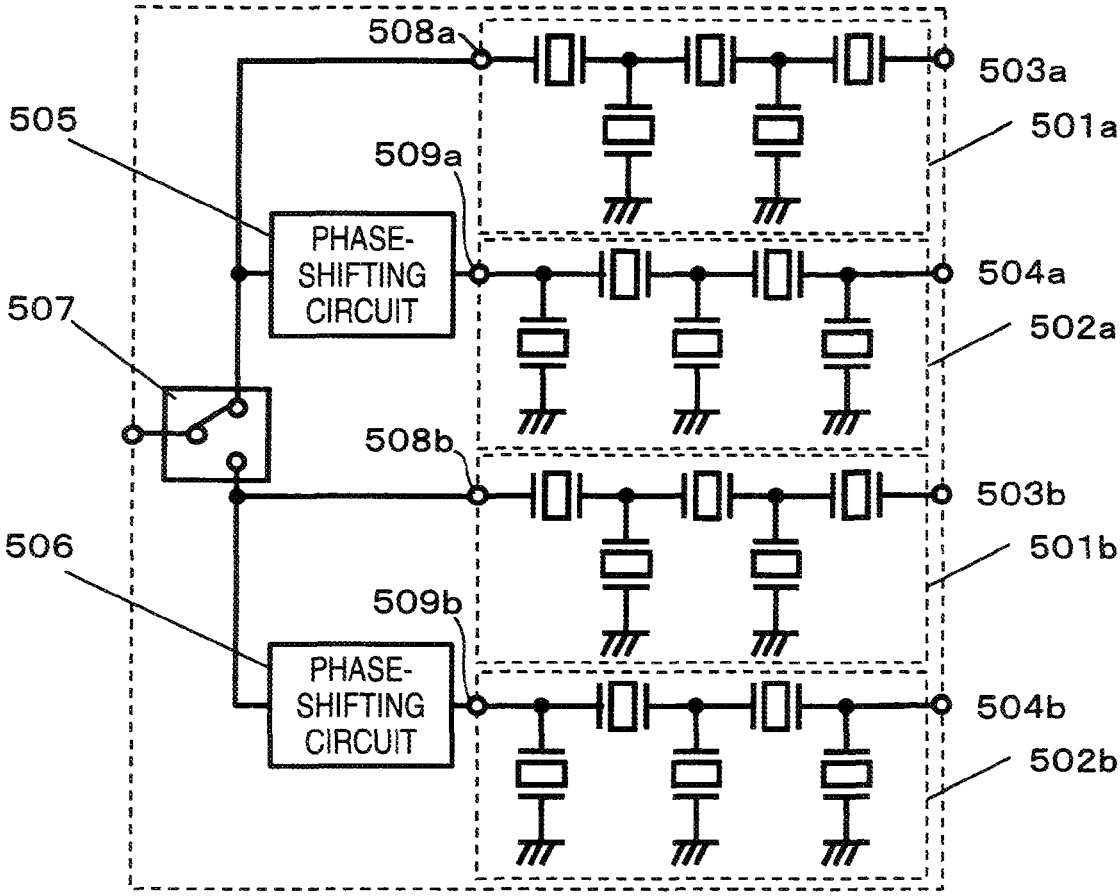
FIG. 20 is a block diagram of a duplexer according to Embodiment 10 of the invention.

FIG. 20 is a drawing showing the configuration of a duplexer according to Embodiment 10. A frequency variable duplexer can be realized by using the duplexer of a plurality of filters (two sets of sending filters 501*a*, 501*b* and receiving filters 502*a*, 502*b*) and phase-shifting circuits 505, 506. The references 503*a*,, 503*b*, 504*a*, 504*b*, 508*a*, 508*b*, 509*a*, 509*b* denote nodes, respectively.

By this configuration, since it is not necessary to arrange a plurality of switches, not only the duplexer can be made smaller in size but also the duplexer can be realized whose loss is reduced compared with a case where switches are individually packaged. The following is the reason for this.

Signals whose frequencies ranging from hundreds MHz to several GHz are handled in radio or wireless communication apparatus. Because of this, the floating capacity and loss caused by a laid out wiring are increased. However, as is described in this embodiment, by the switching configuration in which the actuating portion and the contact portion are separated from each other, isolation can be ensured when the switch is off, and the loss can be reduced. Furthermore, by narrowing the gap of the actuating portion, the voltage necessary for actuation can be reduced, and the response can also be made faster.

Note that while in this embodiment, the duplexer includes the electromechanical switch, the sending filters and the receiving filters. However, the same advantage can be obtained even in the event that the duplexer includes the electromechanical switch and a plurality of sending filters or the electromechanical switch and a plurality of receiving filters.

In addition, while in this embodiment, the frequency variable duplexer is described as being realized through the combination of the filters whose frequency bands are different, an impedance variable duplexer can, needless to say, be realized by combining filters whose impedances are different.

(Embodiment 11)

Figure 21:
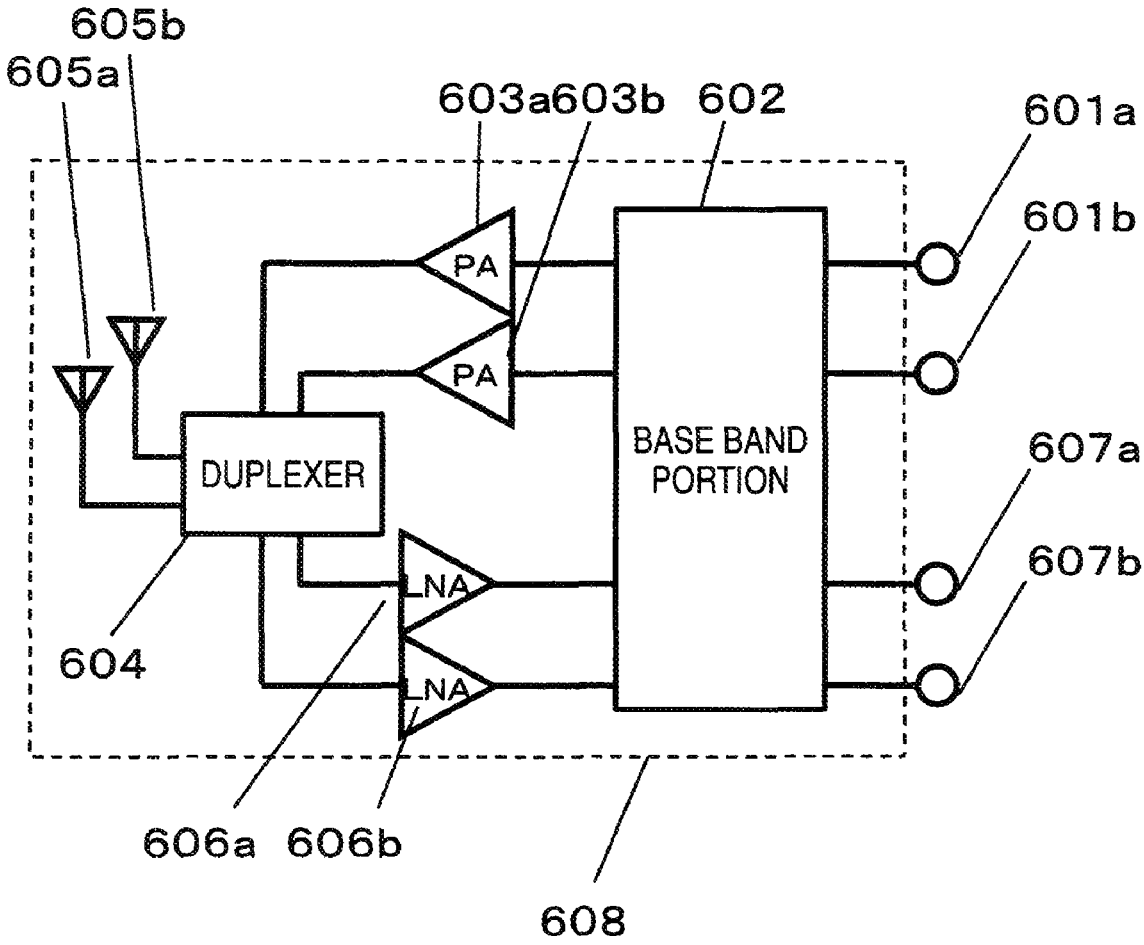
FIG. 21 is a block diagram of communication apparatus according to Embodiment 11 of the invention.
Figure 22A:
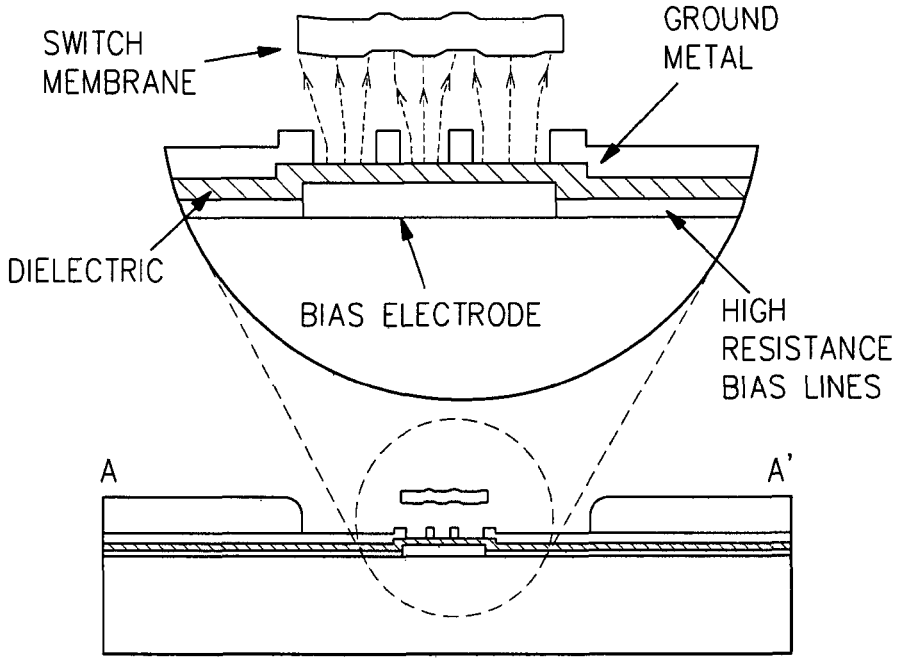
FIG. 22A is a sectional view showing a configuration of the conventional switch.
Figure 22B:
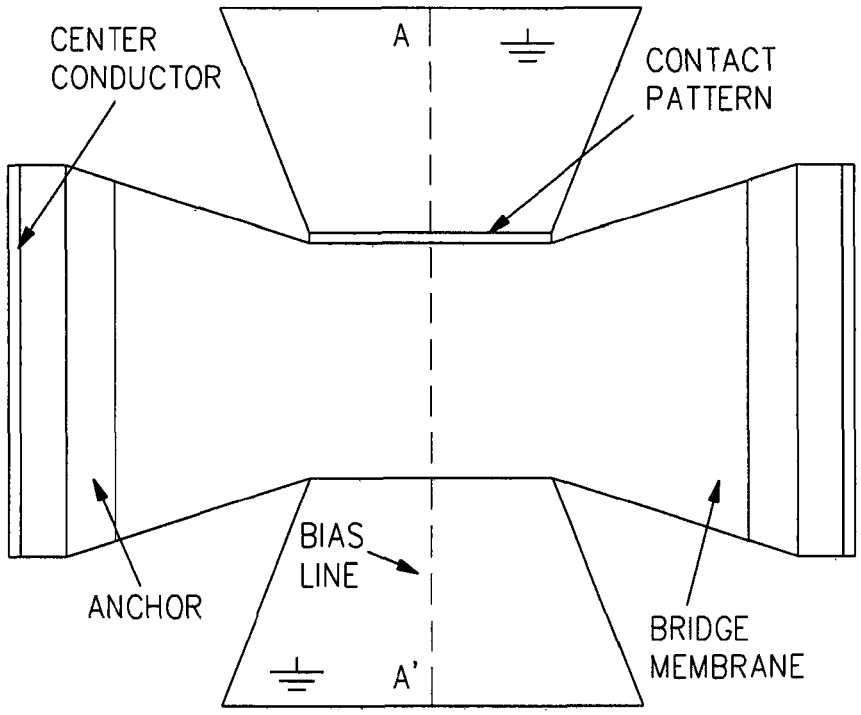
FIG. 22B is a plan view showing the configuration of the conventional switch.

FIG. 21 is a drawing showing the configuration of communication apparatus according to Embodiment 11.

Referring to FIG. 21, reference numeral 604 denotes the duplexer described in Embodiment 10. This device includes antennas 605*a*, 605*b*, an electromechanical switch for switching between two frequency signals, the duplexer 604 which has the piezoelectric thin film resonator filters and other circuit components. By this configuration, the communication apparatus which is small in size and whose loss is small can be realized.

Note that while in the embodiment, no electrode is provided for the first and second beams, resistance loss can be reduced further by forming metallic electrodes of aluminum or the like for those first and second beams. In addition, the difference in magnitude between the first and second gaps may be formed by the thickness of electrodes formed on the beams or by existence and non-existence of electrodes.

It should be understood that all the embodiments that have been described heretofore are illustrative in all respects and are not such as to limit the scope of the invention. It should be construed that the scope of the invention is determined not by the description of the embodiments that have been made heretofore but by the claims thereof and that all changes and modifications are included in the invention which fall within the spirit and scope of the invention which are determined by the claims.

In the electromechanical switch according to the invention, the actuating portion and the contact portion are placed in parallel while being made to be separated from each other, and the displacement generated in the actuating portion is transmitted to the contact portion via the connecting portion for switching. Furthermore, the gap at the actuating portion can be made to differ in magnitude from the gap at the contact portion, whereby the high-speed actuation is enabled while ensuring the required isolation. Because of this, the electromechanical switch of the invention is effective as a switch for a high-frequency circuit or the like which requires good transmission efficiency when transmitting a signal, good insulation when the switch is off or a high-speed operation when a signal is connected or cut off.

In addition, with the filter and the communication apparatus which utilize the electromechanical switch according to the invention, high-speed response and low-loss characteristics can be obtained, and the electromechanical switch is also useful as a switch for switching a plurality of filters and communication systems.

Thus, as has been described heretofore, the electromechanical switch of the invention and the filter and communication apparatus which utilize the same switch are very useful for high-frequency circuits in mobile communication terminals for digital television broadcasting, mobile phones and wireless LAN.

What is claimed is:

1. An electromechanical switch, comprising:

a first beam;

a second beam arranged in parallel with the first beam, and connected to the first beam through a connecting portion;

a first electrode formed so as to have a first gap between the first electrode and the first beam;

a voltage applying portion which applies a voltage between the first beam and the first electrode; and a second electrode formed so as to have a second gap between the second electrode and the second beam, the second gap being greater than the first gap in any portion of the first beam, wherein the first beam is displaced when the voltage applying portion applies the voltage between the first beam and the first electrode, so that switching between the second beam and the second electrode is performed in a state that the first beam is not electrically connected to the first electrode, wherein the first beam is configured as a both-end fixed beam;

wherein the second beam is configured as a cantilevered beam; and wherein the both-end fixed beam is connected to the cantilevered beam through the connecting portion.

2. The electromechanical switch according to claim 1, wherein the first electrode and the second electrode are formed on a substrate;

wherein a pulling force is generated between the first beam and the first electrode when the voltage applying portion applies the voltage between the first beam and the first electrode, so that the first beam is displaced;

wherein the connecting portion transmits a displacement of the first beam to the second beam so that the second beam is displaced; and wherein the second beam contacts with the second electrode to switch on and off an electric signal by a displacement of the second beam.

3. The electromechanical switch according to claim 1, wherein the first beam is displaced by electrostatic force.

4. The electromechanical switch according to claim 1, wherein a surface of the first electrode is covered with an insulation membrane.

5. The electromechanical switch according to claim 1, wherein the first electrode and the second electrode are formed on the same plane.

6. The electromechanical switch according to claim 1, wherein a top face of the second electrode is lower in the height from a common level than that of the first electrode.

7. The electromechanical switch according to claim 1, wherein a plurality of the first beam or a plurality of the second beam are provided.

8. The electromechanical switch according to claim 1, wherein a mechanical resonance frequency of the first beam is different from that of the second beam.

9. The electromechanical switch according to claim 1, wherein a length of the connecting portion is not more than one half of a structural body of the electromechanical switch.

10. The electromechanical switch according to claim 1, wherein a length of the connecting portion is set to one fourth of a structural body of the electromechanical switch.

11. The electromechanical switch according to claim 1, wherein the first beam is displaced by piezoelectric effect.

12. The electromechanical switch according to claim 1, wherein the first beam is displaced by both electrostatic effect and piezoelectric effect.

13. A filter provided with the electromechanical switch set forth in claim 1.

14. A duplexer provided with the electromechanical switch set forth in claim 1.

15. A communication apparatus provided with the duplexer set forth in claim 14.

16. An electromechanical switch, comprising:

a first beam;

a second beam connected to the first beam through a connecting portion;

a first electrode formed so as to have a first gap between the first electrode and the first beam;

a voltage applying portion which applies a voltage between the first beam and the first electrode; and a second electrode formed so as to have a second gap between the second electrode and the second beam, the second gap being greater than the first gap, wherein the first beam is displaced when the voltage applying portion applies the voltage between the first beam and the first electrode, so that switching between the second beam and the second electrode is performed in a state that the first beam is not electrically connected to the first electrode;

wherein the first beam is configured as a both-end fixed beam;

wherein the second beam is configured as a cantilevered beam which is supported at the connecting portion; and wherein when the voltage applying portion applies the voltage between the first beam and the first electrode, a displacement of the second beam is greater than that of the first beam.

* * * * *

UNITED STATES PATENT AND TRADEMARK OFFICE

CERTIFICATE OF CORRECTION

PATENT NO. : 8,115,577 B2
APPLICATION NO. : 12/137812
DATED : February 14, 2012
INVENTOR(S) : Hiroshi Nakatsuka It is certified that error appears in the above-identified patent and that said Letters Patent is hereby corrected as shown below:

In the Specifications:

In column 3, line 8, please delete the first "," and instead insert -- . --

In column 5, line 52, please delete "IA" and instead insert -- 1A --

In column 8, line 42, please delete "tim" and instead insert -- µm --

In column 13, line 49, please delete the second "," and instead insert -- . --

Signed and Sealed this
Third Day of July, 2012

David J. Kappos

David J. Kappos
*Director of the United States Patent and Trademark Office*